US006502934B2

(12) United States Patent
Yamamoto et al.

(10) Patent No.: US 6,502,934 B2
(45) Date of Patent: Jan. 7, 2003

(54) RECORDING APPARATUS

(75) Inventors: Hajime Yamamoto, Yokohama (JP); Masami Amemiya, Tokyo (JP); Hideyuki Sugioka, Ebina (JP); Kenji Shinjo, Yokohama (JP); Toshihiko Bekki, Yokohama (JP); Fumitaka Goto, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/842,055

(22) Filed: Apr. 26, 2001

(65) Prior Publication Data

US 2002/0003564 A1 Jan. 10, 2002

(30) Foreign Application Priority Data

Apr. 28, 2000 (JP) ..... 2000-129361
Apr. 28, 2000 (JP) ..... 2000-131706

(51) Int. Cl.[7] ..... B41J 2/01
(52) U.S. Cl. ..... 347/104; 400/642
(58) Field of Search ..... 399/402, 401, 399/364, 309; 355/24, 26; 271/301, 186, 65; 347/104; 400/625, 636, 642, 578

(56) References Cited

U.S. PATENT DOCUMENTS 4,296,421 A * 10/1981 Hara et al. ..... 347/48
4,607,948 A * 8/1986 Naito ..... 355/24
5,485,991 A 1/1996 Hirano et al. ..... 271/117
5,746,526 A * 5/1998 Hirise ..... 400/619
5,775,823 A 7/1998 Bekki et al. ..... 400/624
6,322,208 B1 * 11/2001 Bugner et al. ..... 347/104

FOREIGN PATENT DOCUMENTS

| | | |
|---|---|---|
| JP | 05-238073 | 9/1993 |
| JP | 07-089140 | 4/1995 |
| JP | 9-327950 | 12/1997 |
| JP | 10-76713 | 3/1998 |
| JP | 11-157757 | 6/1999 |

* cited by examiner

*Primary Examiner*—John Barlow
*Assistant Examiner*—Ly T Tran
(74) *Attorney, Agent, or Firm*—Fitzpatrick, Cella, Harper & Scinto

(57) ABSTRACT

A recording apparatus for effecting recording on a recording medium by a recording head having a first recording portion and a second recording portion includes a recording medium conveying path for conveying the recording medium in opposed relationship with the recording head, and a reversing mechanism portion disposed in the recording medium conveying path, the reversing mechanism portion spacing a first side of the recording medium apart from the first recording portion, and thereafter reversing the recording medium so as to oppose a second side of the recording medium to the second recording portion.

17 Claims, 20 Drawing Sheets

RECORDING APPARATUS

BACKGROUND OF THE INVENTION

1. Field of the Invention

This invention relates to a recording apparatus for effecting recording on the two sides of a recording medium.

2. Related Background Art

Generally in recording apparatuses of the electrophotographic type or the ink jet type, there have been proposed recording apparatuses which can record on the two sides of a sheet-like recording medium. Such recording apparatuses can decrease recording mediums required for recording to half and can also decrease the space for keeping recording mediums after recording to about half, and thus lead to the saving of resources and the saving of space and have recently been spotlighted.

In Japanese Patent Application Laid-Open No. 9-327950 and Japanese Patent Application Laid-Open No. 11-157757, there is described a recording apparatus in which a recording medium on one side of which recording has been effected is reversed and thereafter is re-inserted into a recording portion, and recording is effected on the other side of the recording medium.

Also, in Japanese Patent Application Laid-Open No. 10-76713 and Japanese Patent Application Laid-Open No. 7-89140, there is described a recording apparatus in which recording heads are disposed opposite to the two sides of a recording medium respectively and the respective recording heads record on the two sides of the recording medium.

Further, in Japanese Patent Application Laid-Open No. 5-23807, there is described a recording apparatus in which without a recording medium being reversed, a recording head scans the two sides of the recording medium as a series of operations.

Furthermore, in U.S. Pat. No. 5,746,526, there is described a recording apparatus in which a recording head is made movable relative to the front and back sides of a recording medium disposed in a U-shaped conveying path, whereby the recording head records on the two sides of the recording medium.

However, the recording apparatus described in Japanese Patent Application Laid-Open No. 9-327950 and Japanese Patent Application Laid-Open No. 11-157757 requires a relatively large mechanism for reversing the recording medium. There is also the problem that the time required for delivery, reversal and re-insertion becomes relatively long and therefore the recording speed becomes relatively low.

Also, the recording apparatus described in Japanese Patent Application Laid-Open No. 10-76713 and Japanese Patent Application Laid-Open No. 7-89140 requires two sets of recording heads and two sets of peripheral mechanisms therefor and therefore may rise in manufacturing cost. Also, there is the problem that when the last page of a document of which the last page is an odd page is to be outputted or when recording is to be effected on only one side of back print film, OHP film or the like, one of the recording heads becomes useless.

Also, in the recording apparatus described in Japanese Patent Application Laid-Open No. 5-238073, the posture of the recording portion of the recording head is suddenly vertically reversed and therefore, when for example, the recording portion is of the ink jet recording type, the stability of the static negative pressure of the orifice position of the recording head may lack after reversal. As the result, there arises the problem that a predetermined waiting time is required until recording can be started after reversal or the printing mode is limited to business documents in which the outputting of photographs or the like is not required.

The recording apparatus described in U.S. Pat. No. 5,746,526 also suffers from the problem that the recording medium is reversed and therefore the recording speed becomes relatively low.

SUMMARY OF THE INVENTION

It is an object of the present invention to provide a recording apparatus which can effect recording quickly and reliably on the two sides of a recording medium by the use of a single recording head.

It is another object of the present invention to provide a recording apparatus for effecting recording on a recording medium by a recording head having a first recording portion and a second recording portion, the recording apparatus being provided with a recording medium conveying path for conveying the recording medium in opposed relationship with the recording head, and a reversing mechanism portion disposed in the recording medium conveying path for spacing a first side of the recording medium apart from the first recording portion, and thereafter reversing the recording medium so as to oppose a second side of the recording medium to the second recording portion.

DESCRIPTION OF THE PREFERRED EMBODIMENT

First Embodiment

Figure 1:
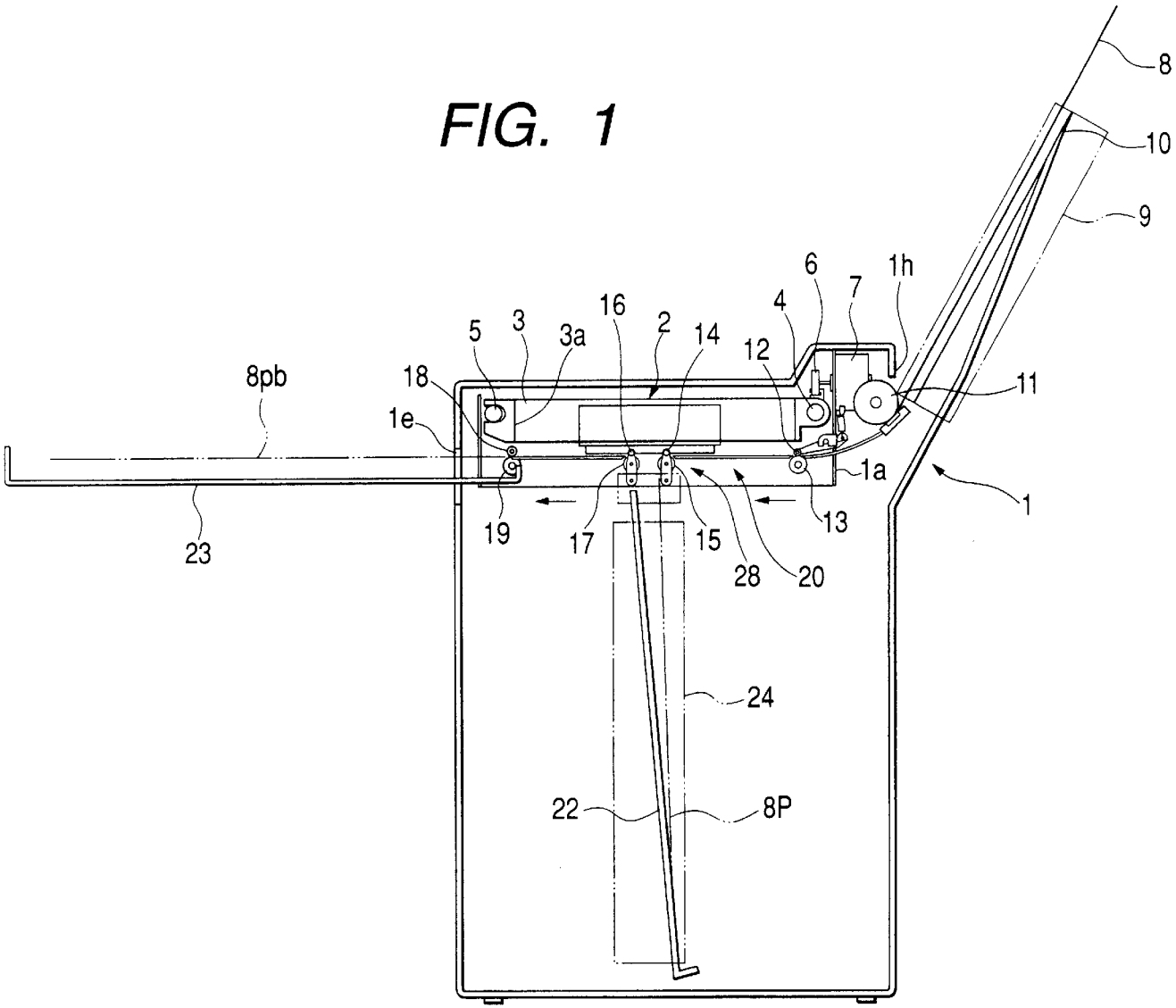
FIG. 1 illustrates the general construction of a recording apparatus according to a first embodiment of the present invention.

FIG. 1 schematically shows the general construction of a recording apparatus according to a first embodiment of the present invention. Referring to FIG. 1, the recording apparatus comprises, as main elements, a feed tray 10 provided inclinedly on one end portion of the upper portion of a frame 1 and stacking thereon a predetermined number of sheets 8 as sheet-like recording mediums, a conveying path 20 formed in the upper portion of the frame 1 and along which the sheets 8 fed from the feed tray 10 are conveyed, a delivery tray 23 provided on the other end portion of the upper portion of the frame 1 and onto which a sheet 8*pb* recorded on both sides thereof is delivered, a recording head unit 2 disposed above the conveying path 20 for effecting recording on both sides of the sheet 8, a carriage 3 for carrying the recording head unit 2 thereon, a reversing mechanism portion 28 disposed below the recording head unit 2 in the conveying path 20 for reversing the sheet 8, an intermediate tray 22 for temporarily holding the sheet 8 thereon, and a tray driving mechanism portion 24 for moving the intermediate tray 22 up and down relative to the reversing mechanism portion 28.

The feed tray 10 has attached thereto an automatic feeding device 9 for feeding the sheets 8 stacked therein one by one. The lower end portions of the automatic feeding device 9 and the feed tray 10 are fixed to the frame 1 so as to face the opening portion 1*h* of the frame 1. A pickup roller 11 for feeding the sheets 8 one by one from the feed tray 10 to the conveying path 20 is provided near the opening portion 1*h* of the frame 1.

On the upstream side of the conveying path 20, there are provided an intermediate roller 13 and a driven roller 12 which cooperate with each other to nip the sheet 8 therebetween and convey the sheet 8 toward the downstream side. Also, on the downstream side of the conveying path 20, there are provided a delivery roller 19 and a delivery driven roller 18 which cooperate with each other to nip therebetween the sheet 8*pb* recorded on both sides thereof and deliver it onto the delivery tray 23. The driving forces of motors, not shown, are transmitted to the intermediate roller 13 and the delivery roller 19 through a driving force transmitting mechanism.

The carriage 3 is supported for reciprocal movement in and out of the plane of the drawing sheet of FIG. 1 by guide shafts 4 and 5 having their opposite end portions in the conveyance direction of the sheet disposed parallel to each other in spaced apart relationship with each other. The opposite end portions of the guide shafts 4 and 5 are supported by the inner support frame 1*a* of the frame 1.

Figure 2:
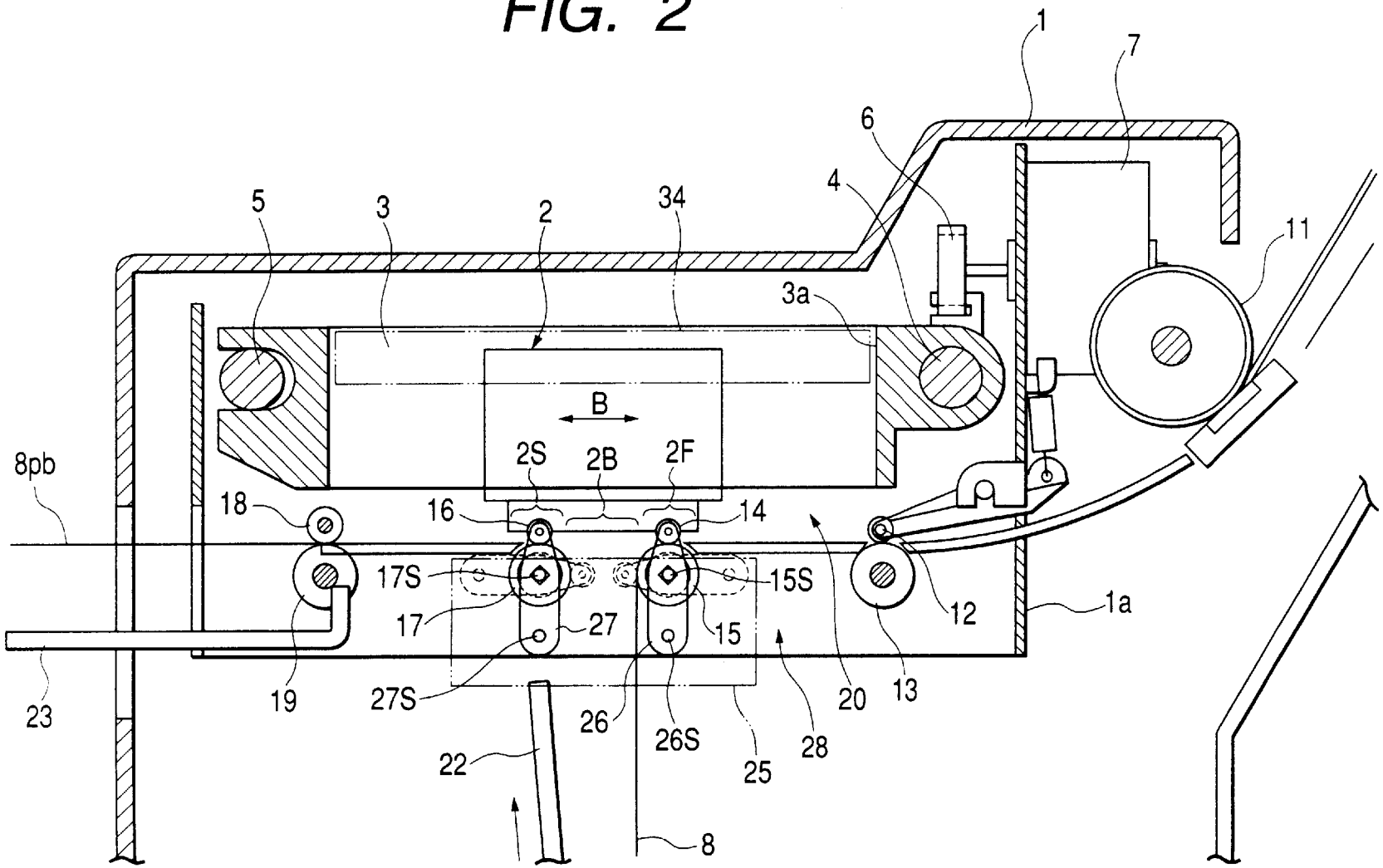
FIG. 2 illustrates the essential portions of the recording apparatus according to the first embodiment.

FIG. 2 illustrates the essential portions of the recording apparatus according to the first embodiment of the present invention. The carriage 3 has a containing portion 3*a* containing the recording head unit 2 therein. In the containing portion 3*a*, there is provided a head shift mechanism 34 for moving the recording head unit 2 in the directions indicated by the double-headed arrow "B" in FIG. 2. Also, the carriage 3 is connected to a timing belt 6. The timing belt 6 is passed over a pair of pulleys rotatably supported on the support frame 1*a*. One of the pair of pulleys is connected to the output shaft of a carrier motor 7 fixed to the support frame 1*a*. When the carrier motor 7 is driven, the carriage 3 carrying the recording head unit 2 thereon is reciprocally moved in and out of the plane of the drawing sheet of FIG. 2.

The recording head unit 2 is provided, for example, with a recording head of the ink jet type. The recording head has ink discharge portions for discharging inks of a plurality of colors (yellow, magenta, cyan and black) to the sheet 8 disposed in opposed relationship therewith. Each ink discharge portion has a plurality of ink discharge ports at predetermined intervals along the conveyance direction of the sheet. Also, the ink discharge portions, as will be described later, are divided into a portion for effecting recording on the front side (recto) of the sheet 8 and a portion for effecting recording on the back side (verso) of the sheet 8. Each ink discharge portion is controlled on the basis of a drive control pulse signal based on image data supplied thereto. Also, the recording head unit 2 has connected thereto an ink tank in which each ink is stored correspondingly to each ink discharge portion.

The reversing mechanism portion 28 comprises, as main elements, a first conveying roller 15 and a second conveying roller 17 rotatably supported by support shafts 15*s* and 17*s*, respectively, disposed on the support frame 1*a* in and out of the plane of the drawing sheet of FIG. 2, a first arm 26 having on one end portion thereof a first pinch roller 14 driven by the first conveying roller 15, a second arm 27 having on one end portion a second pinch roller 16 driven by the second conveying roller 17, and a pivotally movable link mechanism portion 25 connected to the other ends of the first arm 26 and the second arm 27. The first conveying roller 15 and the second conveying roller 17 are divided into a plurality and provided along the center axes of the support shafts 15*s* and 17*s*, respectively. The first conveying roller 15 and the second conveying roller 17 are connected to the output shafts of a common motor by a predetermined transmitting mechanism and a clutch mechanism, respectively.

The pivotally movable link mechanism portion 25 connected to the other end portions of the first arm 26 and the second arm 27 is comprised of a motor, and selectively moves the first arm 26 and the second arm 27 into an inverted state indicated by solid line in FIG. 2 and a horizontal state indicated by the alternate long and two short dash line in FIG. 2, respectively. Thereby, when the motor is driven and the first arm 26 is brought from its horizontal state into its inverted state, the sheet 8 conveyed by the intermediate roller 13 and the driven roller 12 is nipped by the nip portion between the first conveying roller 15 and the first pinch roller 14, and twines around the outer periphery of the first conveying roller 15 with the revolution of the first pinch roller 14 and changes its course by 90°, and is conveyed to the intermediate tray 22 below by the first conveying roller 15.

On the other hand, when the sheet 8 is pushed up from the intermediate tray 22 below and is nipped by the nip portion between the second conveying roller 17 and the second pinch roller 16, the second arm 27 is brought from its horizontal state into its inverted state, and the sheet 8 twines around the outer periphery of the second conveying roller 17 with the revolution of the second pinch roller 16 and changes its course by 90°, and is conveyed toward the delivery roller 19 and the delivery driven roller 18.

Accordingly, a sheet reversing mechanism of compact and simple construction is realized by a combination of the first conveying roller 15 and the first pinch roller 14, and a combination of the second conveying roller 17 and the second pinch roller 16. It is desirable that the distance between the first pinch roller 14 and the second pinch roller 16 be made small to the utmost.

As shown in FIG. 1, the lower end of the intermediate tray 22 extends downwardly into the frame 1. The lowermost end portion of the intermediate tray 22 is bent so that the sheet 8*p* having an image recorded on a first side thereof may be held thereon. The upper end of the intermediate tray 22 is disposed in proximity to the second conveying roller 17. The intermediate tray 22 is supported by a tray driving mechanism portion 24. The tray driving mechanism portion 24 includes a swinging mechanism for swinging the intermediate tray 22, and a lift mechanism for moving the upper end portion of the intermediate tray 22 toward or away from the second conveying roller 17.

The operation of the recording apparatus will now be described.

Figure 3A:
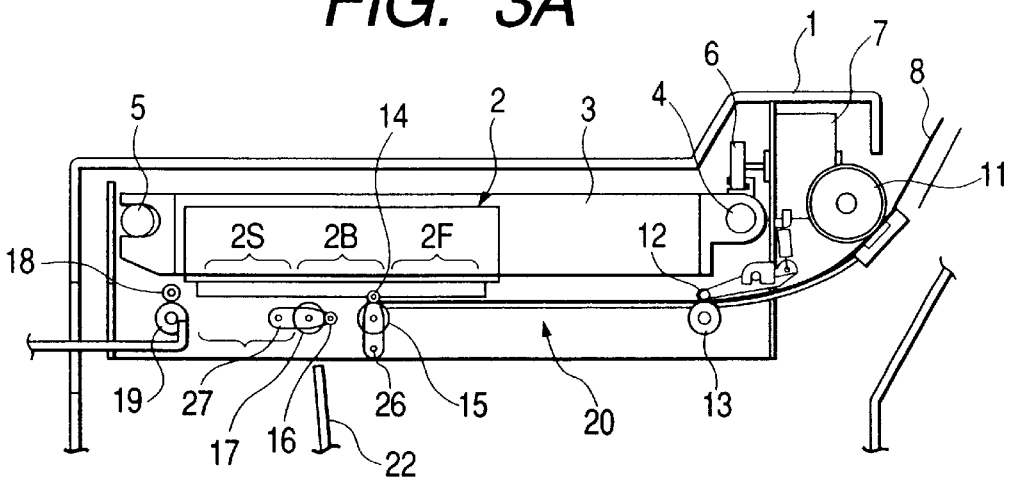
FIGS. 3A, 3B and 3C illustrate the operation of the recording apparatus according to the first embodiment.

When as shown in FIG. 3A, the sheet 8 is fed to the conveying path 20, the pivotally movable link mechanism portion 25 is controlled to thereby stop the first arm 26 in its inverted state. The leading end of the sheet 8 then comes into the nip portion between the first conveying roller 15 and the first pinch roller 14.

Figure 3B:
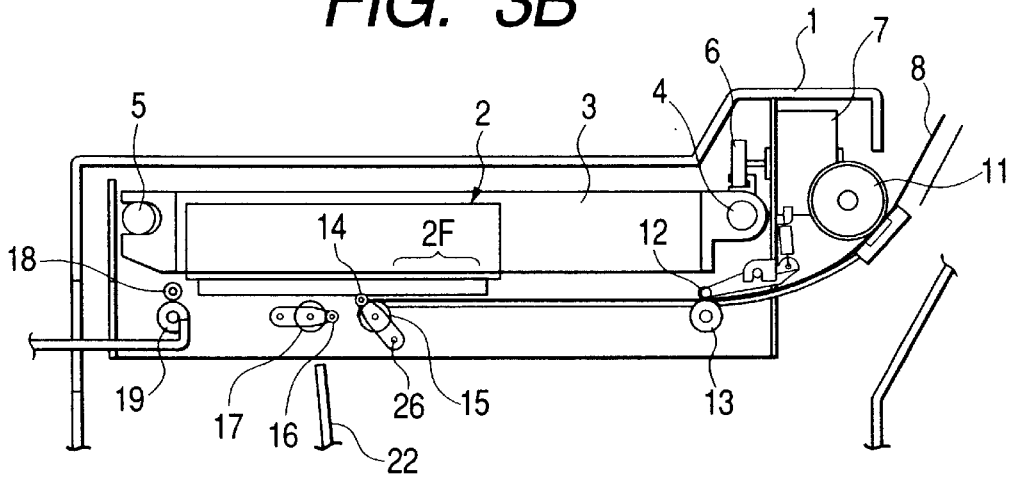
Figure 3C:
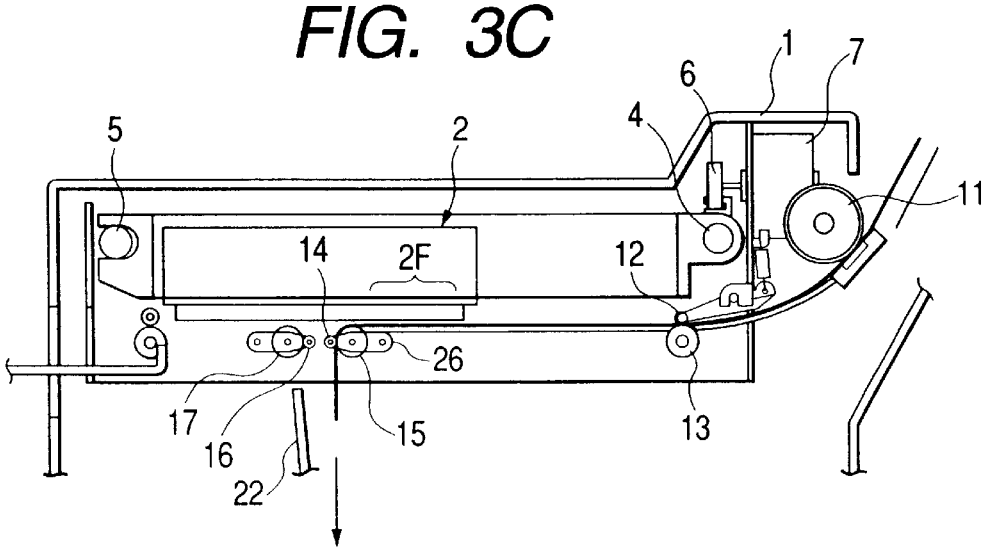

Next, in conformity with a signal from a sensor, not shown, for detecting the position of the sheet, the pivotally movable link mechanism portion 25 is controlled to thereby pivotally move the first arm 26, as shown in FIGS. 3B and 3C. In synchronism with the intermediate roller 13 conveying the sheet 8, the sheet is conveyed by the first conveying roller 15 and the first pinch roller 14 revolves counterclockwisely while nipping the leading end of the sheet 8. Thereafter, the first conveying roller 15 is rotated until the sheet 8*p* having an image recorded on the first side thereof falls onto the intermediate tray 22, and when the first pinch roller 14 becomes horizontal relative to the first conveying roller 15, the pivotal movement of the first arm 26 is stopped.

In the meantime, recording is effected on the first side of the sheet 8 by the recording head unit 2. At that time, the recording is effected by a first discharge portion 2F of a preset ink discharge portion.

Figure 4A:
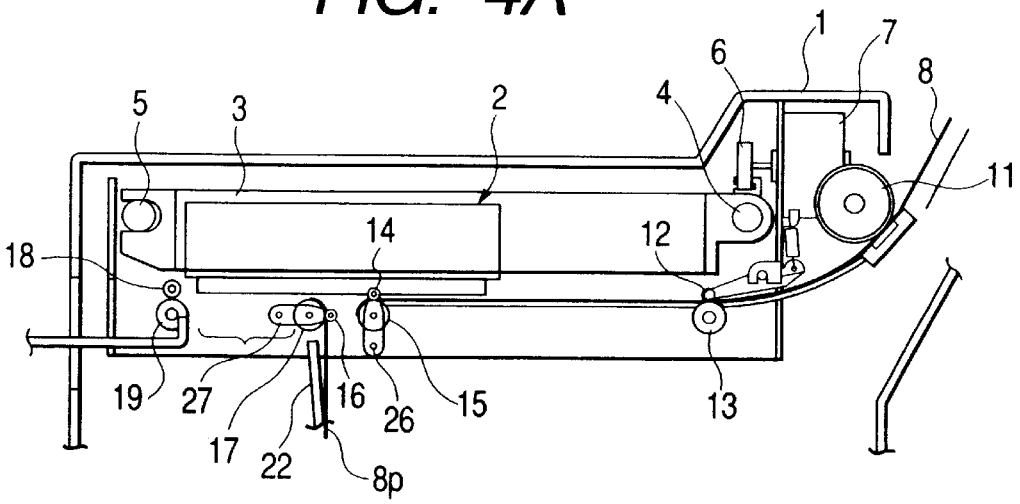
FIGS. 4A, 4B and 4C illustrate the operation of the recording apparatus according to the first embodiment.
Figure 4B:
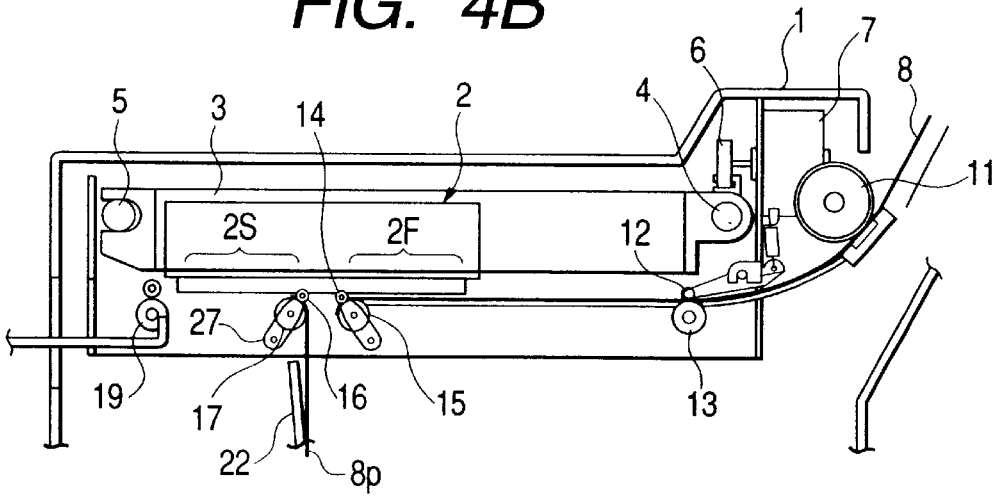
Figure 4C:
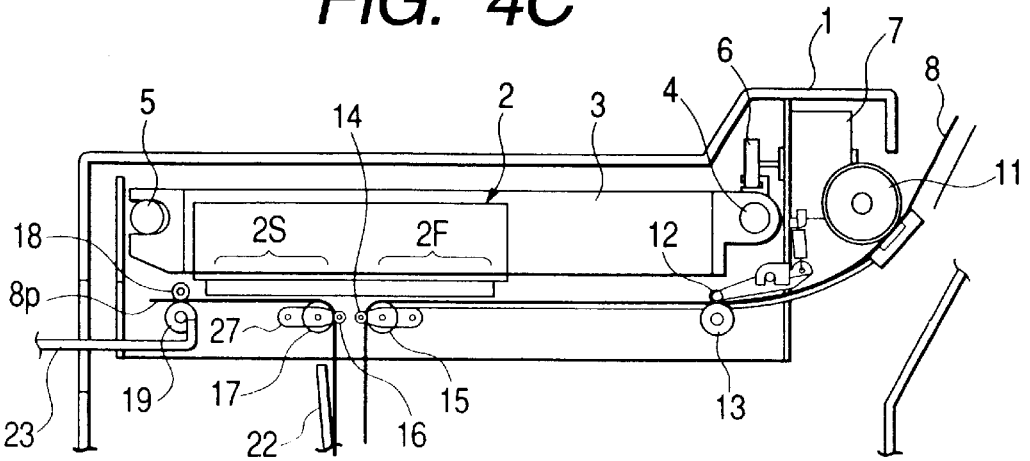

Next, the link mechanism portion 25 is controlled so that as shown in FIG. 4A, the end portion of the sheet 8*p* on the first side of which recording has been effected and which is held on the intermediate tray 22 can come into the nip portion between the second conveying roller 17 and the second pinch roller 16, and the second arm 27 is pivotally moved so that the second pinch roller 16 may become horizontal relative to the second conveying roller 17. When as shown in FIGS. 4B and 4C, the end portion of the sheet 8*p* comes into the nip portion between the second conveying roller 17 and the second pinch roller 16, the second arm 27 is pivotally moved with the rotation of the second conveying roller 17, and the sheet 8*p* recorded on the first side thereof is conveyed to a position opposed to a second discharge portion 2S of the ink discharge portion of the recording head unit 2. Recording is then effected on a second side of the sheet 8*p* by the second discharge portion 2S, and the sheet 8*pb* on both sides of which recording has been effected is delivered to the delivery tray 23. Between the first discharge portion 2F and the second discharge portion 2S, there is formed a row of ink discharge ports 2B which is not utilized for recording. By the ink discharge portion widely covering the first conveying roller 15 and the second conveying roller 17, recording on the first side is effected in the area between the intermediate roller 13 and the first conveying roller 15, and recording on the second side is effected in the area between the second conveying roller 17 and the delivery roller 19. That is, recording can be effected on both sides of the sheet by substantially one recording head unit 2.

A sheet pressing plate or the like may be provided to prevent the sheet 8*p* from floating up during the time until the sheet 8*p* is nipped by the nip portion between the delivery roller 19 and the delivery driven roller 18. Also, when the first arm 26 and the second arm 27 are pivotally moved, the recording head unit 2 waits at a predetermined position in the main scanning direction so that the arms and the recording head unit 2 may not interfere with each other.

A similar conveying operation and a similar recording operation are performed for the second and subsequent sheets 8.

Figure 5A:
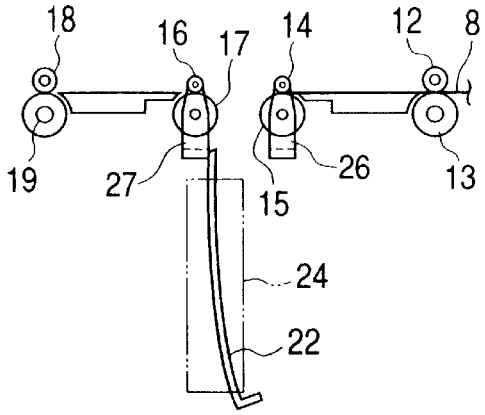
FIGS. 5A, 5B, 5C, 5D, 5E and 5F illustrate the operation of the tray driving mechanism portion of the recording apparatus according to the first embodiment.

The operation of the tray driving mechanism portion 24 will now be described with reference to FIGS. 5A to 5F. When recording is effected by the first discharge portion 2F while the sheet 8 is conveyed after as shown in FIGS. 5A and 5B, the leading end of the sheet 8 has been nipped by the nip portion between the first conveying roller 15 and the first pinch roller 14, the tray driving mechanism portion 24 is controlled to thereby move the lower end portion of the intermediate tray 22 in the direction indicated by the arrow C so as to hold the lower end of the sheet 8*p* as shown in FIG. 5C until recording on the first side of the sheet 8 is terminated. At that time, the intermediate tray 22 is held so that the lower end portion thereof may lie at the right of a common tangent L with the first conveying roller 15 and the first pinch roller 14. Thereby, the sheet 8*p* which has fallen is automatically held in contact with the intermediate tray 22. Further, the intermediate tray 22 is positioned so that the upper end of the sheet 8 may underlie the second conveying roller 17 and the second pinch roller 16.

Figure 5D:
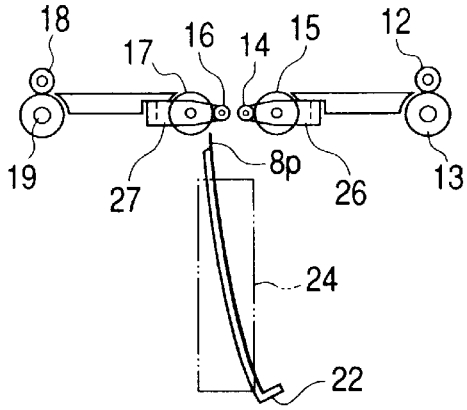
Figure 5B:
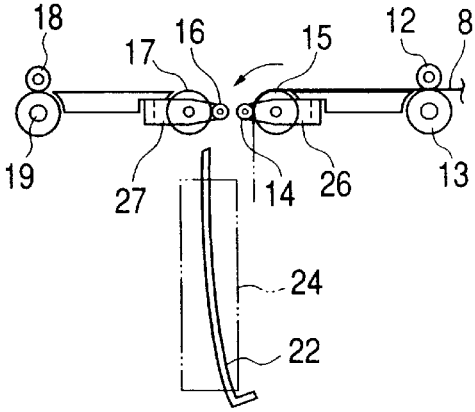
Figure 5E:
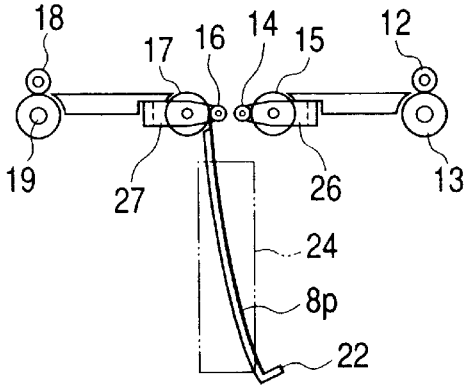
Figure 5C:
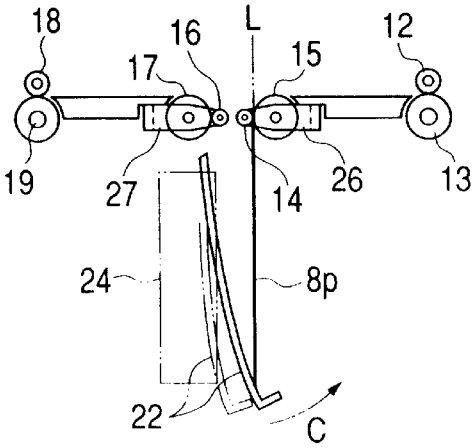
Figure 5F:
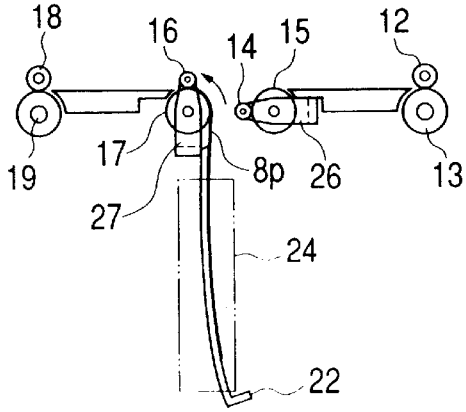

Subsequently, as shown in FIG. 5D, the sheet 8*p* is completely held on the intermediate tray 22, whereafter the tray driving mechanism portion 24 is controlled to thereby move up the intermediate tray 22 so that as shown in FIG. 5E, the end portion of the sheet 8*p* may become proximate to the second conveying roller 17 and the second pinch roller 16. Thereby, the upper end of the sheet 8*p* is nipped by the nip portion between the second conveying roller 17 and the second pinch roller 16. Then, as shown in FIG. 5F, the second arm 27 is pivotally moved in synchronism with the rotation of the second conveying roller 17, whereby the sheet 8*p* is elevated and is conveyed toward the downstream side with respect to the conveyance direction of the sheet.

Second Embodiment

A second embodiment of the present invention will now be described with reference to FIGS. 6A, 6B, 6C and 7. In the second embodiment, the recording head unit 2 is moved in the conveyance direction of the sheet on the carriage 3 by the head shift mechanism 34.

Figure 6A:
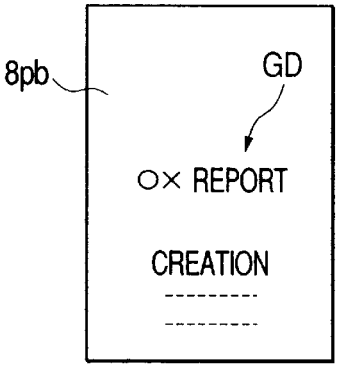
FIGS. 6A, 6B and 6C illustrate images to be recorded in a second embodiment of the present invention.
Figure 6B:
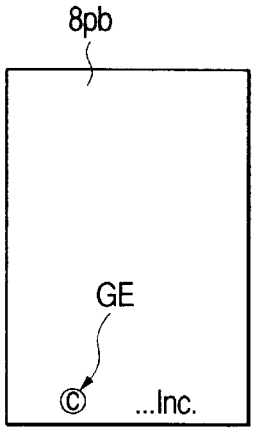
Figure 6C:
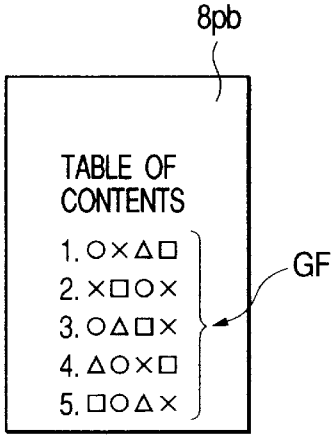

FIGS. 6A to 6C illustrate images to be recorded in the second embodiment. FIG. 6A shows image data on a first side (front surface) of the first one of sheets on which recording is to be continuously effected, and there are images GD at the center and lower portion thereof. FIG. 6B shows image data on a second side (back surface) of the first one of the sheets on which recording is to be continuously effected, and there is a relatively small image GE in the lower portion thereof, FIG. 6C shows image data on a first side (front surface) of the second one of the sheets on which recording is to be continuously effected, and there is an image GF substantially at the center thereof. On a second side (back surface) of the second sheet, there is no image data to be recorded. When the images as shown in FIGS. 6A to 6C are to be recorded, they can be recorded at a high speed by using the head shift mechanism.

Figure 7:
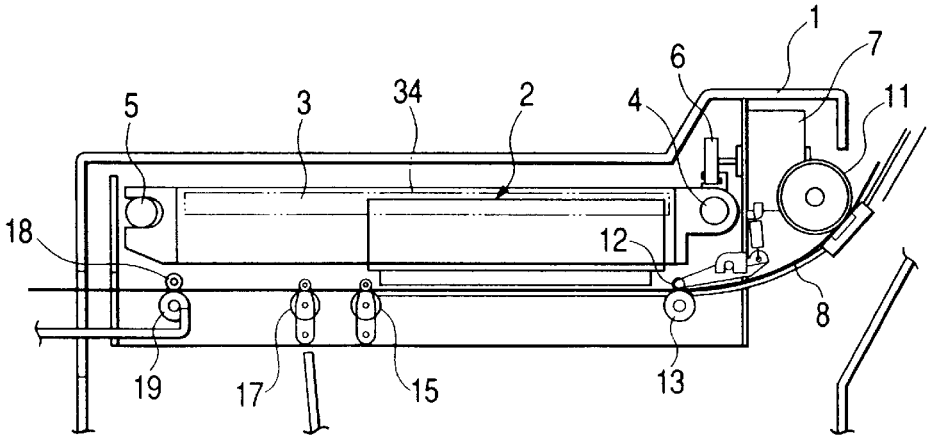
FIG. 7 illustrates the operation of a recording apparatus according to the second embodiment.

The operation of the recording apparatus will hereinafter be described with reference to FIG. 7. The image data as shown in FIGS. 6A and 6B are recorded on the two sides of the first sheet 8, whereafter as shown in FIG. 7, the head shift mechanism 34 is controlled to thereby move the recording head unit 2 to the position between the intermediate roller 13 and the first conveying roller 15. Recording can be effected only on the first side of the second sheet and therefore, the pivotally movable link mechanism 25 need not be operated. The sheet 8 is conveyed by the first conveying roller 15 and the second conveying roller 17 and also, recording is effected thereon by the recording head unit 2.

According to the construction described above, the head shift mechanism 34 is controlled to thereby move the recording head unit 2 after recording has been effected on the first sheet and therefore, the recording speed can be improved.

Third Embodiment

A third embodiment of the present invention will now be described with reference to FIGS. 8A and 8B. In the third embodiment, even when recording is to be effected only on one side of the sheet, the pivotally movable link mechanism 25 is operated.

Figure 8A:
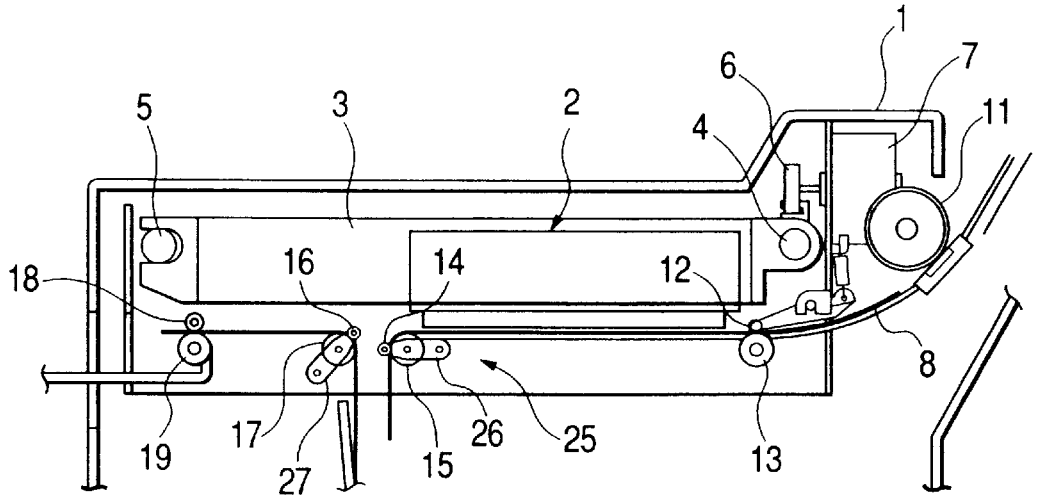
FIGS. 8A and 8B schematically illustrate the construction of a recording apparatus according to a third embodiment of the present invention.
Figure 8B:
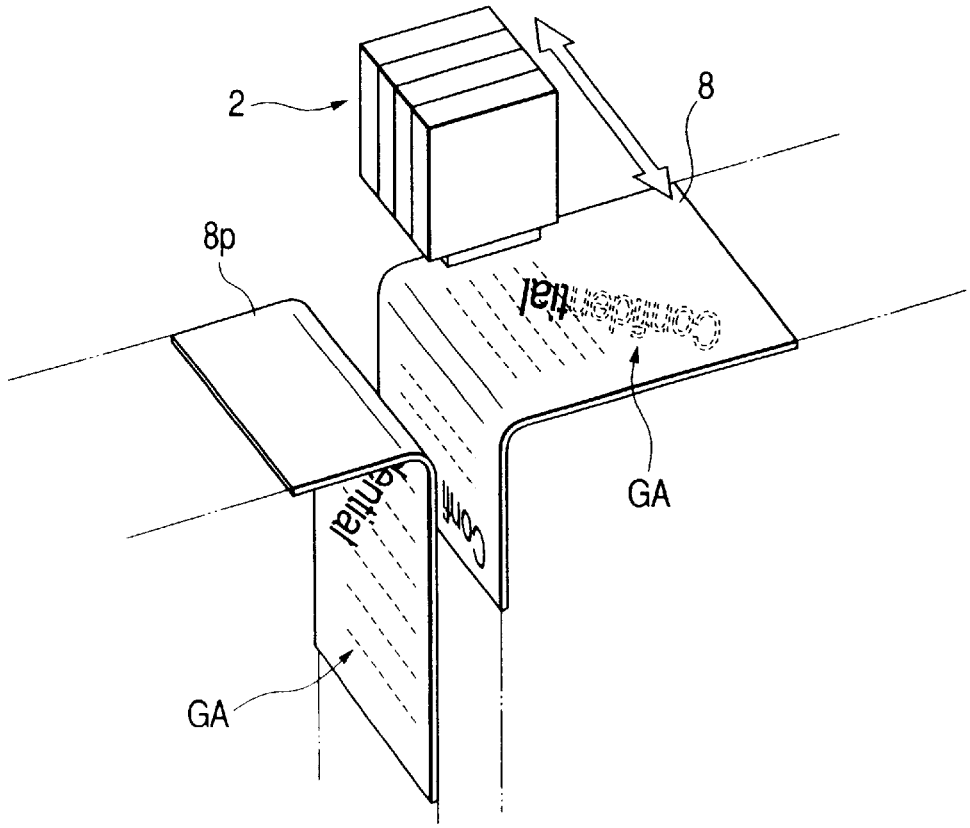

As shown in FIG. 8A, the recording head unit 2 is at the position between the intermediate roller 13 and the first conveying roller 15. When recording is being effected on a first side of the sheet 8, the pinch rollers 14 and 16 can be pivotally moved independently of the recording operation and therefore, almost without the recording speed being reduced, face-down delivery in which the side on which recording has been done is not seen becomes possible.

Fourth Embodiment

A fourth embodiment of the present invention will now be described with reference to FIG. 9. In the fourth embodiment, control is effected so as to move the position of the recording head unit 2 on the carriage 3 in conformity with image data.

Figure 9:
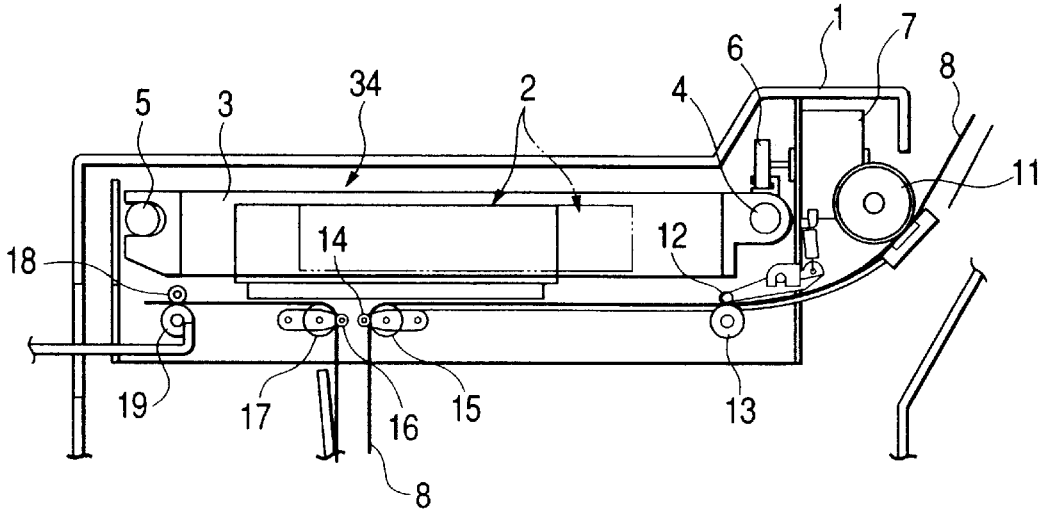
FIG. 9 illustrates a fourth embodiment of the present invention.

As shown in FIG. 9, when the head shift mechanism 34 is to be controlled, the position of the recording head unit 2 is changed to a position indicated by solid line or a position indicated by the alternate long and two short dash line in conformity with the size and disposition of images on the front and back sides of the sheet at the predetermined timing as when recording on the first side of the sheet has been completed. That is, the allotment of the first discharge portion for recording on the first side and the second discharge portion for recording on the second side is not always fixed in a one-to-one relationship, but is variably controlled in conformity with image data.

Also, when the recording head unit 2 is of the ink jet type, the head shift mechanism 34 may be controlled in order to prevent the ink in the discharge ports between the first conveying roller 15 and the second conveying roller 17 from adhering. When the head shift mechanism 34 is to be controlled, it is necessary to control it with the time for moving the recording head unit 2 taken into account so that the throughput may not lower.

Figure 10:
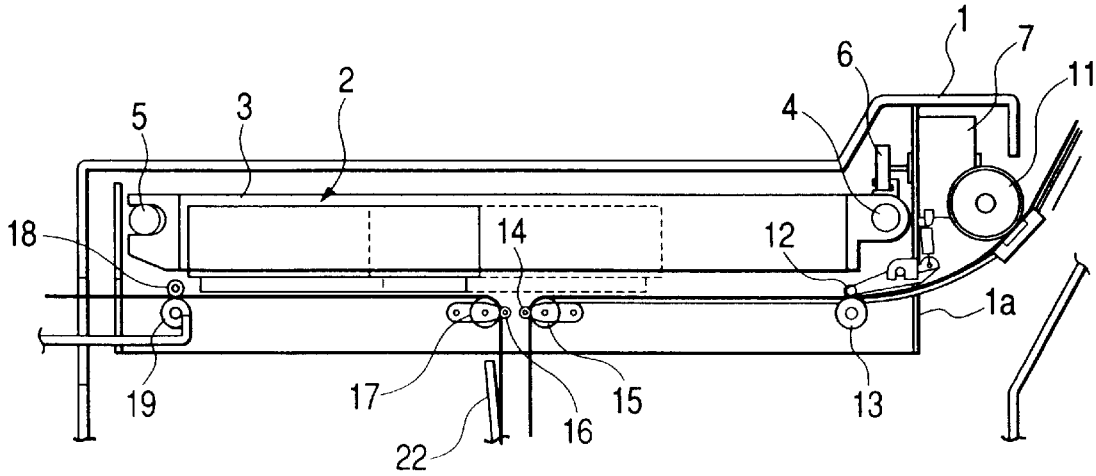
FIG. 10 illustrates the fourth embodiment.

Further, as shown in FIG. 10, there may be secured a space for enabling the recording head unit 2 to be housed between the second conveying roller 17 and the delivery roller 19.

According to the above-described construction, even during the recording on the first side of the first sheet which necessarily becomes one-side recording when both-side recording is to be effected or during the recording only on one side, the discharge ports can be effectively used by the head shift mechanism and the recording speed can be improved.

Fifth Embodiment

A fifth embodiment of the present invention will now be described with reference to FIGS. 11A to 11D and 12. In the fifth embodiment, when recording is to be effected on a recording medium such as OHP which is used with light transmitted and projected, images are divisionally recorded on a first side (front surface) and a second side (back surface) of the recording medium.

Figure 11A:
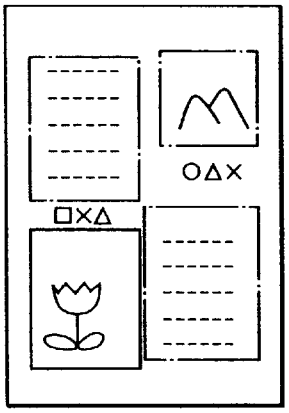
FIGS. 11A, 11B, 11C and 11D illustrate images to be recorded in a fifth embodiment of the present invention.
Figure 11B:
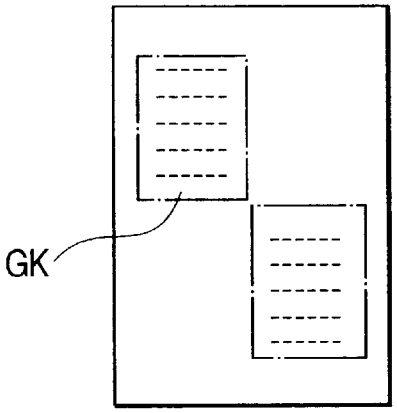
Figure 11C:
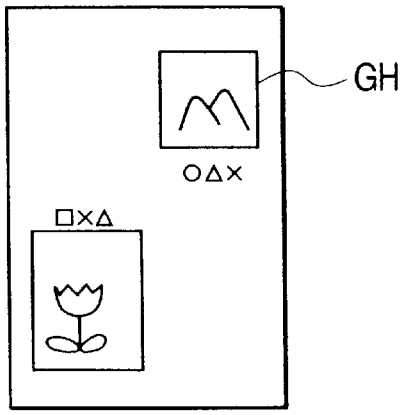
Figure 11D:
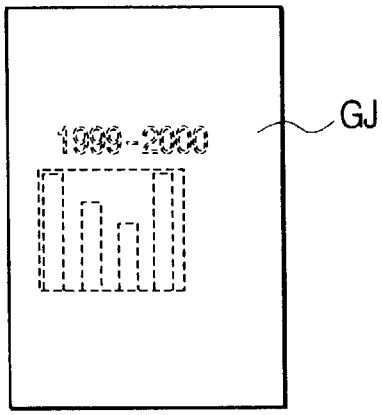
Figure 12:
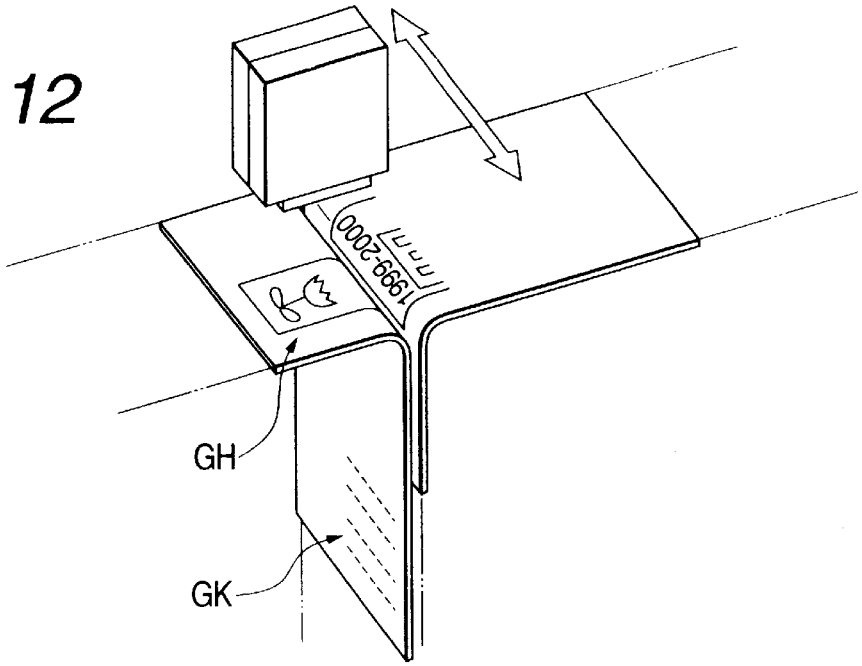
FIG. 12 illustrates the recording operation of the fifth embodiment.

Regarding image data supplied from a host computer 40, it is to be understood that image data to be recorded on the first sheet is what is shown in FIG. 11A and image data to be recorded on the second sheet is what is shown in FIG. 11D. In that case, the image on the first sheet is divided as shown in FIGS. 11B and 11C and the thus divided images are recorded on the first side and second side, respectively, of the recording medium. In the present embodiment, as shown in FIG. 12, monochromatic character data GK is recorded on the first side, and a color image GH is recorded on the second side.

As the recording medium, in a medium comprising a high molecular receiving layer of ink jet ink applied to thin polyester film or the like, it is often the case that in order to prevent the film from being curled after the application, receiving layers are applied to both sides of the medium. Therefore, the effect of the present embodiment can be obtained even if a special transparent medium is not prepared.

Sixth Embodiment

A sixth embodiment of the present invention will now be described with reference to FIG. 13. In the sixth embodiment, control is effected so as to shift a portion of the recording head unit.

Figure 13:
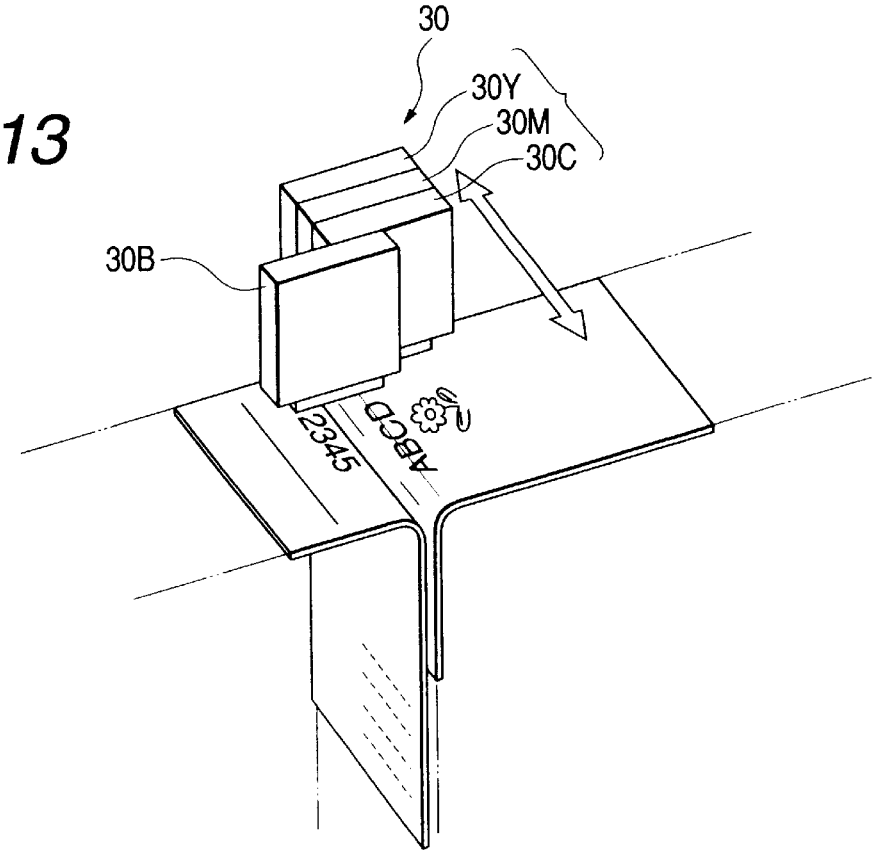
FIG. 13 illustrates a sixth embodiment of the present invention.

As shown in FIG. 13, of a plurality of recording heads 30Y, 30M, 30C and 30B, a certain group and the other group are controlled so as to be shifted independently of one another. The black recording head 30B and the recording heads 30Y, 30M and 30C corresponding to three colors are shifted independently of one another, whereby when color graphics recording is effected on a first side of the sheet 8 and monochromatic text recording is effected on a second side of the sheet 8, the recording speed can be improved. Further, if the forwarding of data to the recording heads and the driving of the recording heads for gradation control are possible, the first discharge portion and the second discharge portion in each recording head are differently driven, whereby the required dignity of recording can also be changed.

Also, the head shift mechanism may be designed to be controlled by the creation rate of particularly effective patterns or an effect obtained. The black recording head 30B and the recording heads 30Y, 30M, 30C corresponding to three colors may be completely shifted to the above-described first area while remaining deviated from each other to thereby provide a time difference between the shooting of the color inks and the shooting of the black ink when attention is paid to the recorded portion of the same side. This is particularly effective for a combination of penetration color inks and a black ink overlying a sheet (high surface tension ink).

Seventh Embodiment

Figure 14:
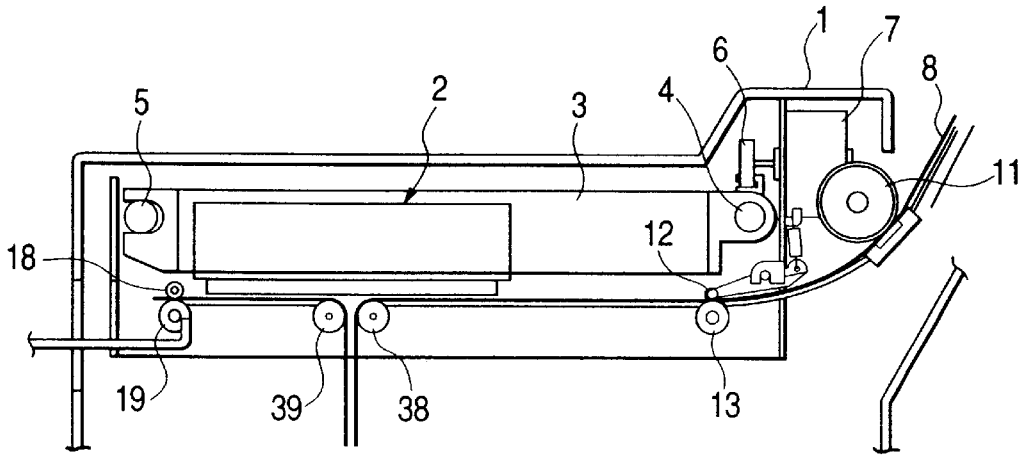
FIG. 14 illustrates a seventh embodiment of the present invention.

A seventh embodiment of the present invention will now be described with reference to FIG. 14. In the present embodiment, as shown in FIG. 14, the conveying rollers are electrostatic attraction type rollers 38 and 39.

According to the above-described construction, the distance between the rollers 38 and 39 can be made small and therefore, the discharge ports of the recording head unit which are not utilized for recording during both-side recording can be decreased.

Eighth Embodiment

Figure 15:
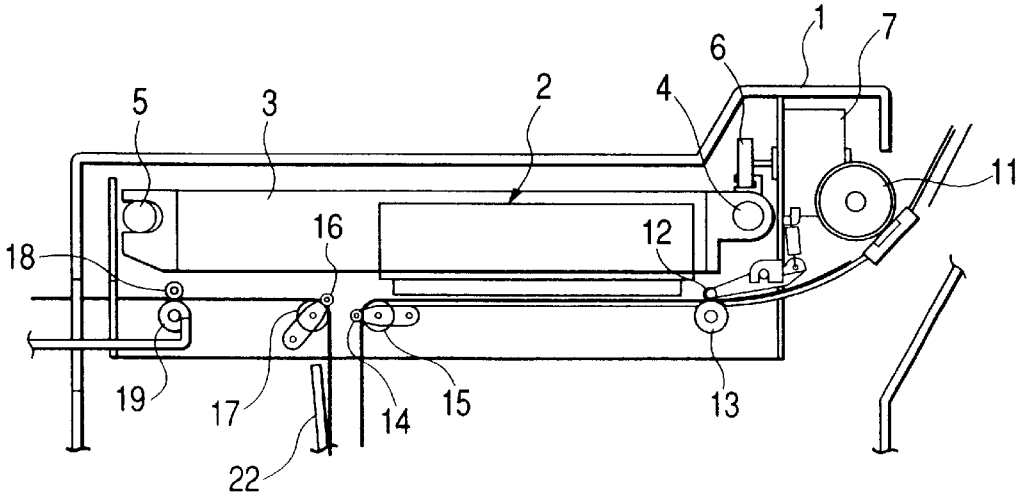
FIG. 15 illustrates an eighth embodiment of the present invention.

An eighth embodiment of the present invention will now be described with reference to FIG. 15. In the present embodiment, as shown in FIG. 15, the conveyance of the sheet by the first pinch roller 14 and the conveyance of the sheet by the second pinch roller 16 are not synchronized with each other.

According to the above-described construction, a calculating process for enabling the recording by recording head shift within the shortest time to be done is carried out and the conveyance of the recording medium by the pinch rollers is delayed by a necessary time, whereby the substantial time for one-side recording can be secured more.

Also, while in the above-described embodiments, the intermediate tray 22 has been described as being of a construction in which a plurality of sheets are not stocked, it may be designed to stock a plurality of sheets therein in order to secure the time for drying.

Also, the recording head unit 2 can cope with various recording methods, but the combination thereof with the ink jet recording method as non-contact recording is most effective. Also, the supply of the inks to the recording head unit may be the liquid supply by the coupling of joints or the opening and closing of a valve, but may also be of the non-contact flying type. Further, for the forwarding of the recording signal from the recording apparatus to the recording head unit, and the forwarding of head temperature information, non-discharge detection information, bad ink supply information, etc. from the recording head unit to the recording apparatus, use may be made of not only electrical cable connection, but also cable connection using light, or non-contact connection using light, radio or electrostatic induction.

Ninth Embodiment

A ninth embodiment of the present invention will now be described with reference to FIGS. 16, 17A, 17B, 18A and 18B. While in the afore described embodiments, the pivotally movable link mechanism is provided in the frame on the conveying path along a horizontal direction, in the present embodiment, pivotally movable link mechanism is provided in the course of a conveying path 90 along the vertical direction of a frame 71.

Figure 16:
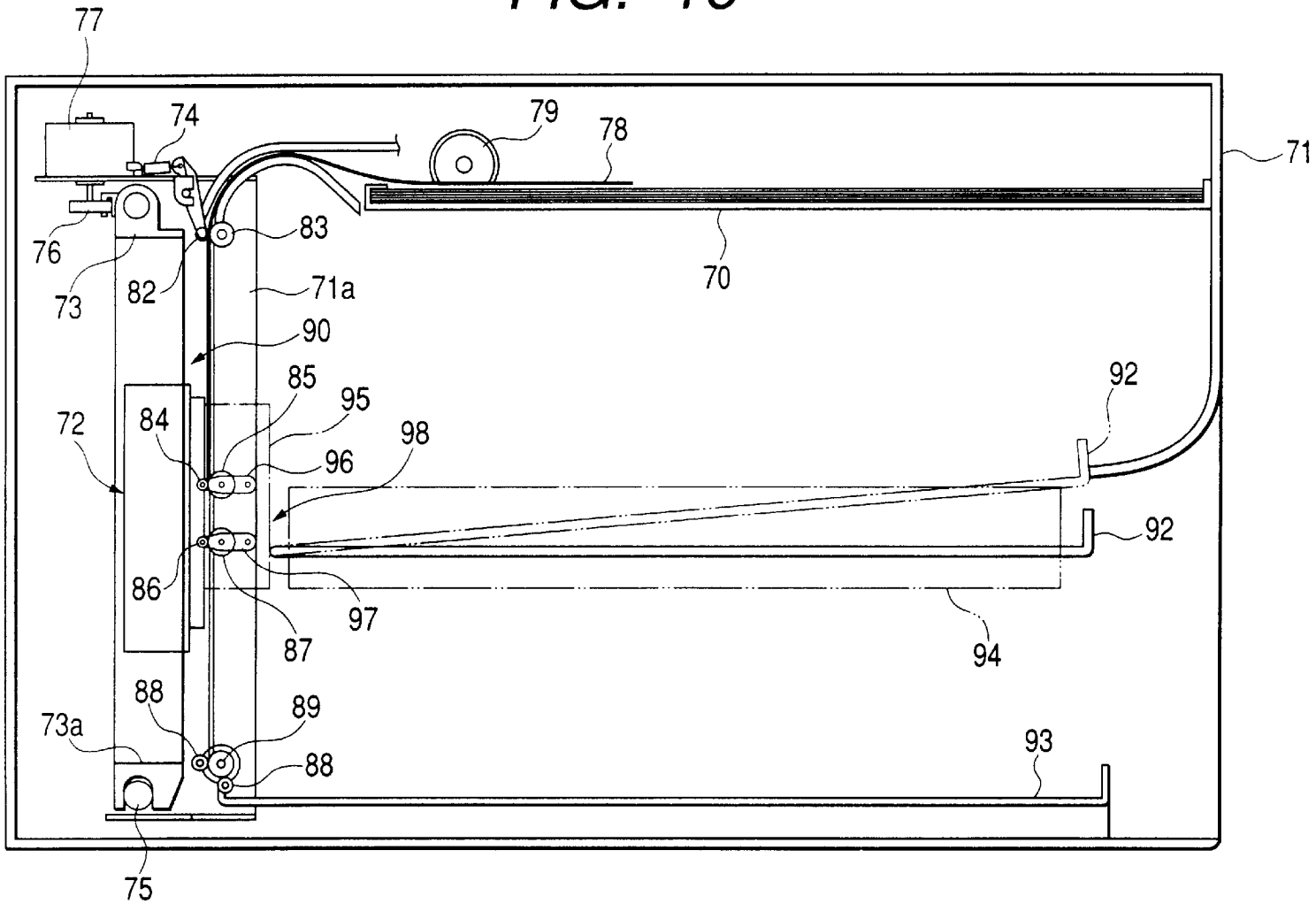
FIG. 16 illustrates the general construction of a recording apparatus according to a ninth embodiment of the present invention.

Referring to FIG. 16, the recording apparatus comprises, as main elements, a feed tray 70 provided in the upper portion of the frame 71 and stacking thereon a predetermined number of sheets 78 as sheet-like recording mediums, a conveying path 90 formed in a direction substantially orthogonal to the feed tray 70 and along which the sheet 78 fed from the feed tray 70 is conveyed, a delivery tray 93 provided in the lower portion of the frame 71 and onto which a sheet 78*pb* (not shown) having an image recorded on both sides thereof is delivered, a recording head unit 72 disposed in opposed relationship with the conveying path 90 for effecting recording on both sides of the sheet 78, a carriage 73 carrying the recording head unit 72 thereon, a reversing mechanism portion 98 provided between the feed tray 70 and the delivery tray 93 for reversing the sheet 78, an intermediate tray 92 for temporarily holding the sheet thereon, and a tray driving mechanism portion 94 for moving the intermediate tray 92 toward and away from the reversing mechanism portion 98. The reversing mechanism portion 98 and the tray driving mechanism portion 94 are similar in structure to the reversing mechanism portion 28 and the tray driving mechanism portion 24 in the first embodiment. The recording head unit 72 is also similar in structure to the recording head unit 2 in the first embodiment. When the recording head unit 72 is of the ink jet type, it is necessary to make supply negative pressure design with the pressure head difference between the most upstream nozzle and the most downstream nozzle taken into account.

On the upstream side of the conveying path 90, there are provided an intermediate roller 83 and a driven roller 82 which cooperate with each other to nip the sheet 78 therebetween and convey it toward the downstream side. Also, on the downstream side of the conveying path 90, there are provided a delivery roller 89 and a delivery driven roller 88 which cooperate with each other to nip therebetween a sheet 78*pb* (not shown) having an image recorded on both sides thereof and deliver it onto a delivery tray 93. The driving forces of motors, not shown, are transmitted to the intermediate roller 83 and the delivery roller 89 through a driving force transmitting mechanism.

The carriage 73 is supported for reciprocal movement in and out of the plane of the drawing sheet of FIG. 16 by guide shafts 74 and 75 having their opposite end portions in the conveyance direction of the sheet disposed parallel to each other in spaced apart relationship with each other. The opposite end portions of the guide shafts 74 and 75 are supported by the inner support frame 71*a* of the frame 71.

The carriage 73 has a containing portion 73*a* containing the recording head unit 72 therein. In the containing portion 73*a*, there is provided a head shift mechanism for moving the recording head unit 72 along the conveying path 90. Also, the carriage 73 is connected to a timing belt 76. The timing belt 76 is passed over a pair of pulleys rotatably supported on the support frame 71*a*. One of the pair of pulleys is connected to the output shaft of a carrier motor 77 fixed to the support frame 71*a*. When the carrier motor 77 is driven, the carriage 73 carrying the recording head unit 72 thereon is reciprocally moved in and out of the plane of the drawing sheet of FIG. 16.

The reversing mechanism portion 98 comprises, as main elements, a first conveying roller 85 and a second conveying roller 87 rotatably supported on support shafts disposed on the support frame 71*a* in and out of the plane of the drawing sheet of FIG. 16, a first arm 96 having on one end portion thereof a first pinch roller 84 driven by the first conveying roller 85, a second arm 97 having on one end portion thereof a second pinch roller 86 driven by the second conveying roller 87, and a pivotally movable link mechanism portion 95 connected to the other ends of the first arm 96 and the second arm 97.

The right end of the intermediate tray 92 is bent so that the sheet 78*p* having an image recorded on one side thereof may be held thereon. The left end of the intermediate tray 92 is disposed in proximity to the second conveying roller 87. Also, the intermediate tray 92 is supported by the tray driving mechanism portion 94. The tray driving mechanism portion 94 includes a swinging mechanism for swinging the intermediate tray 92 to a position indicated by the alternate long and two short dash line, and a mechanism for moving the left end portion of the intermediate tray 92 toward or away from the second conveying roller 87.

The operation of the recording apparatus will now be described. When the sheet 78 is supplied to the conveying path 90, the pivotally movable link mechanism portion 95 is controlled to thereby stop the first arm 96 so that the first pinch roller 84 may become horizontal relative to the first conveying roller 85. Then the leading end of the sheet 78 comes into the nip portion between the first conveying roller 85 and the first pinch roller 84.

Figure 17A:
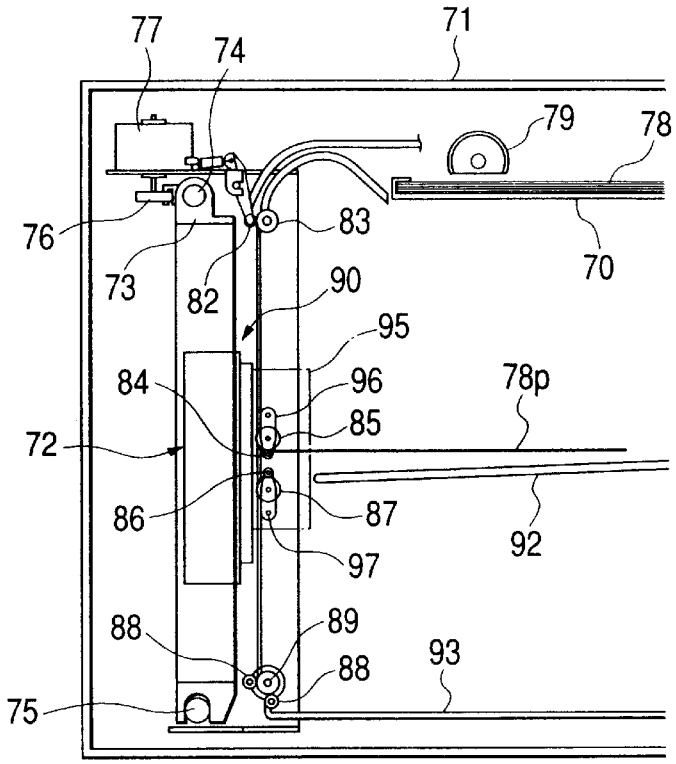
FIGS. 17A and 17B illustrate the operation of the recording apparatus according to the ninth embodiment.
Figure 17B:
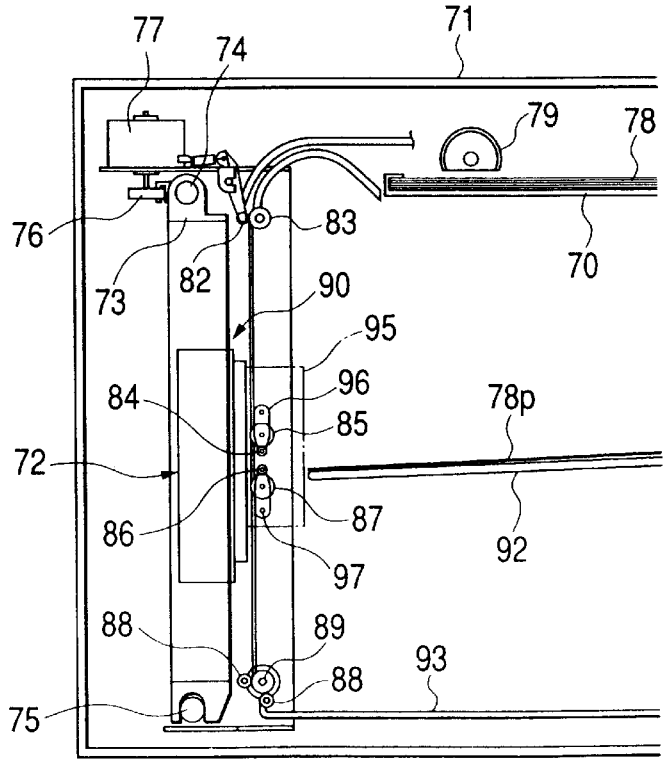

Next, the pivotally movable link mechanism portion 95 is controlled in conformity with a signal from a sensor, not shown, for detecting the position of the sheet to thereby pivotally move the first arm 96. Then the sheet is conveyed by the first conveying roller 85 in synchronism with the intermediate roller 83 conveying the sheet 78 and also, the first pinch roller 84 revolves counter-clockwisely while nipping the leading end of the sheet 78. Thereafter, the first conveying roller 85 is rotated until as shown in FIGS. 17A and 17B, the sheet 78*p* on the first side of which recording has been effected falls onto the intermediate tray 92, and when the first pinch roller 84 becomes inverted relative to the first conveying roller 85, the pivotal movement of the first arm 96 is stopped.

In the meantime, recording is effected on a first side of the sheet 78 by the recording head unit 72. At that time, the recording is effected by a first discharge portion of the preset ink discharge portion.

Figure 18A:
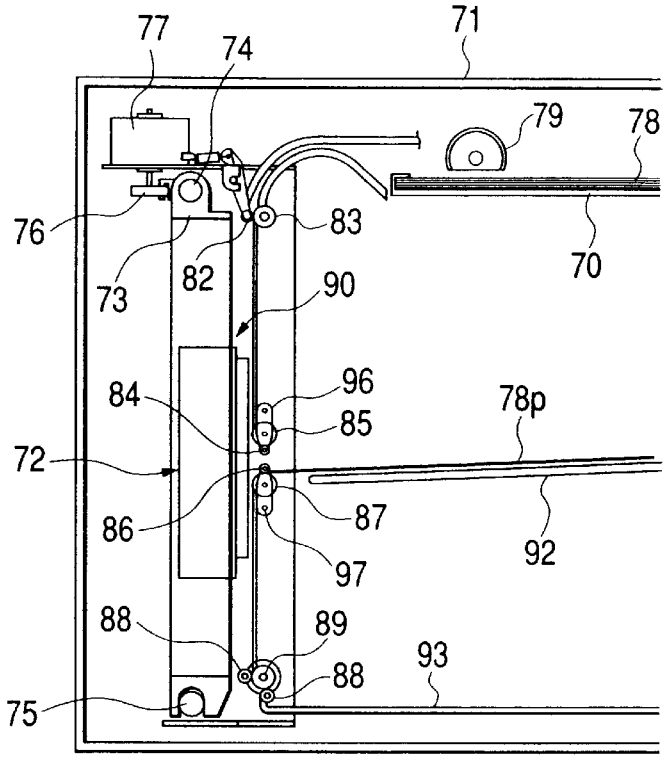
FIGS. 18A and 18B illustrate the operation of the recording apparatus according to the ninth embodiment.
Figure 18B:
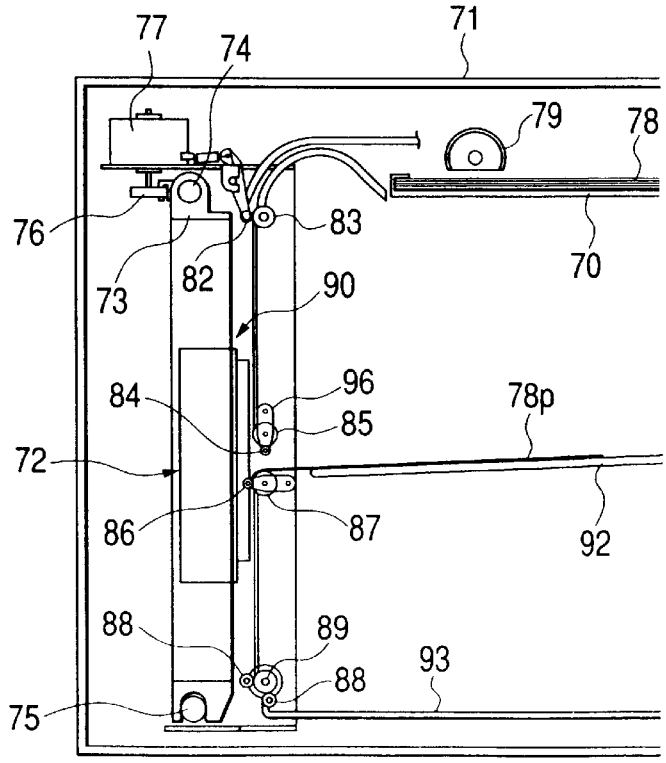

Next, the link mechanism portion 95 is controlled so that as shown in FIG. 18A, the end portion of the sheet 78*p* on the first side of which recording has been effected and which is held on the intermediate tray 92 can come into the nip portion between the second conveying roller 87 and the second pinch roller 86, and the second arm 97 is pivotally moved so that the second pinch roller 86 may become inverted relative to the second conveying roller 87. When as shown in FIG. 18A, the end portion of the sheet 78*p* comes into the nip portion between the second conveying roller 87 and the second pinch roller 86, the second arm 97 is pivotally moved with the rotation of the second conveying roller 87, as shown in FIG. 18B, whereby the sheet 78*p* recorded on the first side thereof is conveyed to a position opposed to a second discharge portion of the ink discharge portion of the recording head unit 72. Then, recording is effected on a second side of the sheet 78*p* from the second discharge portion, and the sheet 78*pb* (not shown) on both sides of which recording has been effected is delivered onto the delivery tray 93.

Design is made such that when the first arm 96 and the second arm 97 are pivotally moved, the recording head unit 72 stands by at a predetermined position in the main scanning direction so that the arms and the recording head unit 72 may not interfere with each other.

Tenth Embodiment

A tenth embodiment of the present invention will now be described with reference to FIGS. 19, 20A and 20B.

Figure 19:
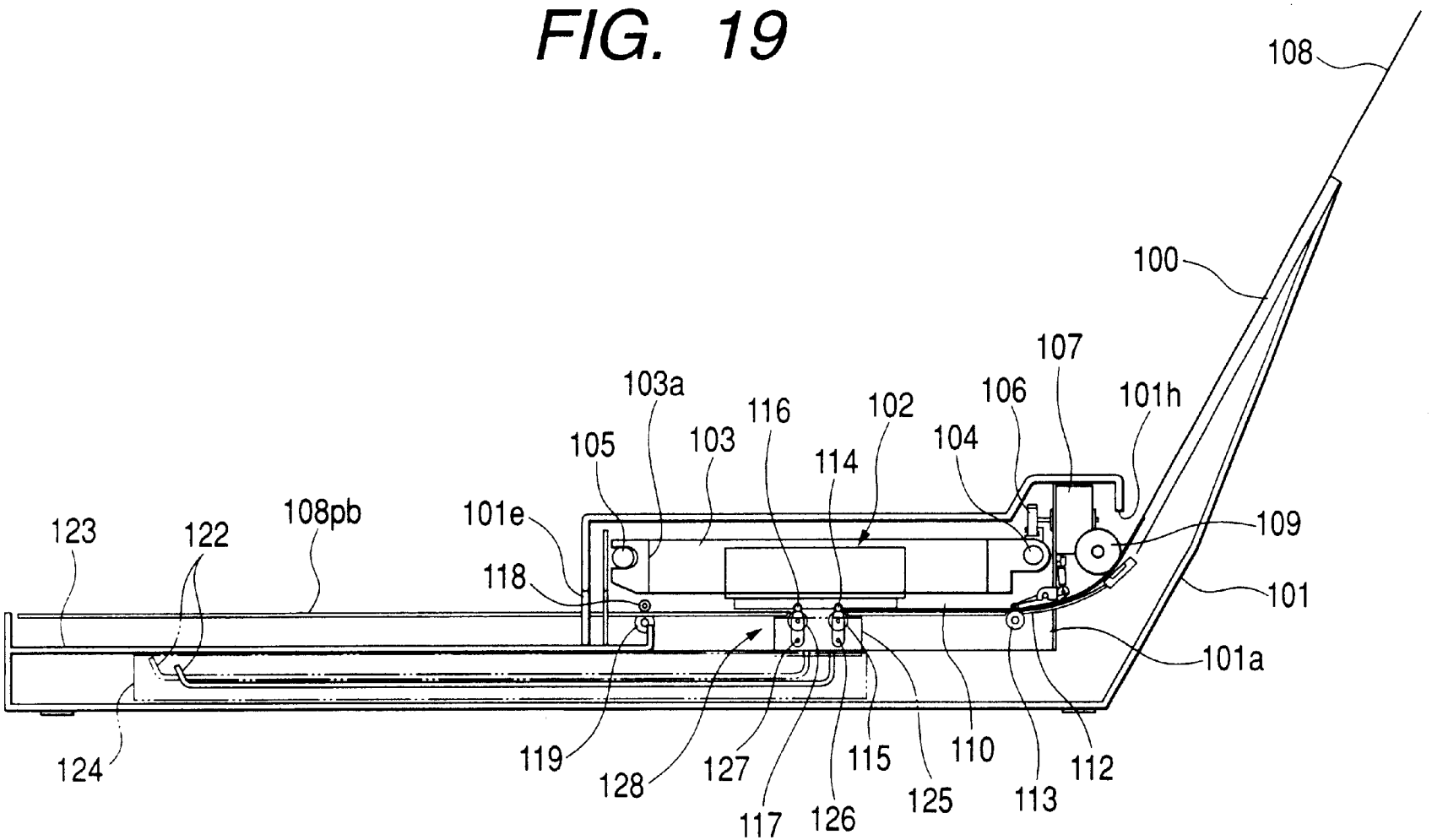
FIG. 19 illustrates the general construction of a recording apparatus according to a tenth embodiment of the present invention.
Figure 20A:
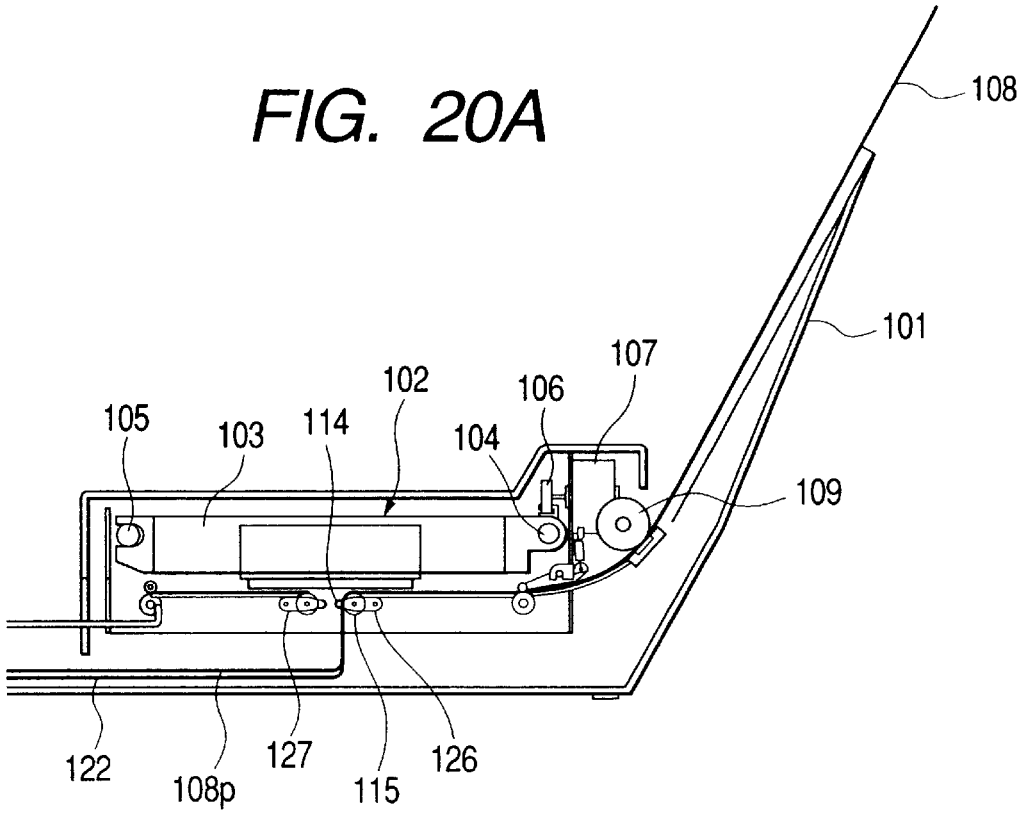
FIGS. 20A and 20B illustrate the operation of the recording apparatus according to the tenth embodiment.

Referring to FIG. 19, the recording apparatus comprises, as main elements, a feed tray 100 stacking thereon a predetermined number of sheets 108 as sheet-like recording mediums, a conveying path 110 along which the sheets 108 fed from the feed tray 100 are conveyed, a delivery tray 123 to which a sheet 108*pb* having images recorded on both sides thereof is delivered, a recording head unit 102 for effecting recording on both sides of the sheet 108, a carriage 103 carrying the recording head unit 102 thereon, a reversing mechanism portion 128 for reversing the sheet 108, an intermediate tray 122 for temporarily holding the sheet thereon, and a tray driving mechanism portion 124 for moving the intermediate tray 122 up and down relative to the reversing mechanism portion 122. The structure of the reversing mechanism portion 128 and the tray driving mechanism portion 124 is similar to the structure of the reversing mechanism portion 28 and the tray driving mechanism portion 24 in the first embodiment. The recording head unit 102 is also similar in structure to the recording head unit 2 in the first embodiment.

In FIG. 19, the lower end portion of the feed tray 100 is fixed to a frame 101 so as to face the opening portion 101*h* of the frame 101. Near the opening portion 101*h* of the frame 101, there is provided a pickup roller 109 for feeding the sheets 108 stacked on the feed tray 100 one by one to the conveying path 110. On the upstream side of the conveying path 110, there are provided an intermediate roller 113 and a driven roller 112 which cooperate with each other to nip the sheet 108 therebetween and convey it toward the downstream side. Also, on the downstream side of the conveying path 110, there are provided a delivery roller 119 and a delivery driven roller 118 which cooperate with each other to nip therebetween the sheet 108*pb* on both sides of which recording has been effected and deliver it onto the delivery tray 123. The driving forces of motors, not shown, are connected to the intermediate roller 113 and the delivery roller 119, respectively, through a driving force transmitting mechanism.

The reversing mechanism portion 128 comprises, as main elements, a first conveying roller 115 and a second conveying roller 117 rotatably supported on support shafts disposed on a support frame 101*a* in and out of the plane of the drawing sheet of FIG. 19, a first arm 126 having on one end portion thereof a first pinch roller 114 driven by the first conveying roller 115, a second arm 127 having on one end portion thereof a second pinch roller 116 driven by the second conveying roller 117, and a pivotally movable link mechanism portion 125 connected to the other ends of the first arm 126 and the second arm 127.

The left end of the intermediate tray 122 is bent so that the sheet 108*p* on one side of which recording has been effected may be held thereon. The right end of the intermediate tray 122 is disposed in proximity to the second conveying roller 117. Also, the intermediate tray 122 is supported by the tray driving mechanism portion 124. The tray driving mechanism portion 124 includes a swinging mechanism for swinging the intermediate tray 122 to a position indicated by the alternate long and two short dash line, and a lift mechanism for moving the right end portion of the intermediate tray 122 toward or away from the second conveying roller 117.

The operation of the recording apparatus will now be described. When the sheet 108 is supplied to the conveying path 110, the pivotally movable link mechanism portion 125 is controlled to thereby stop the second arm 126 so that the first pinch roller 124 may become inverted relative to the first conveying roller 125. The leading end of the sheet 108 then comes into the nip portion between the first conveying roller 115 and the first pinch roller 114.

Next, the pivotally movable link mechanism portion 125 is controlled in conformity with a signal from a sensor, not shown, for detecting the position of the sheet to thereby pivotally move the first arm 126. In synchronism with the intermediate roller 113 conveying the sheet 108, the sheet 108 is conveyed by the first conveying roller 115 and also, the first pinch roller 114 revolves counter-clockwisely while nipping the leading end of the sheet 108. Thereafter, the first conveying roller 115 is rotated until as shown in FIG. 20A, the sheet 108*p* on a first side of which recording has been effected falls onto the intermediate tray 122, and when the first pinch roller 114 becomes horizontal relative to the first conveying roller 115, the pivotal movement of the first arm 126 is stopped.

In the meantime, recording is effected on a first side of the sheet 108 by the recording head unit 102. At that time, the recording is effected by the first discharge portion of a preset ink discharge portion.

Figure 20B:
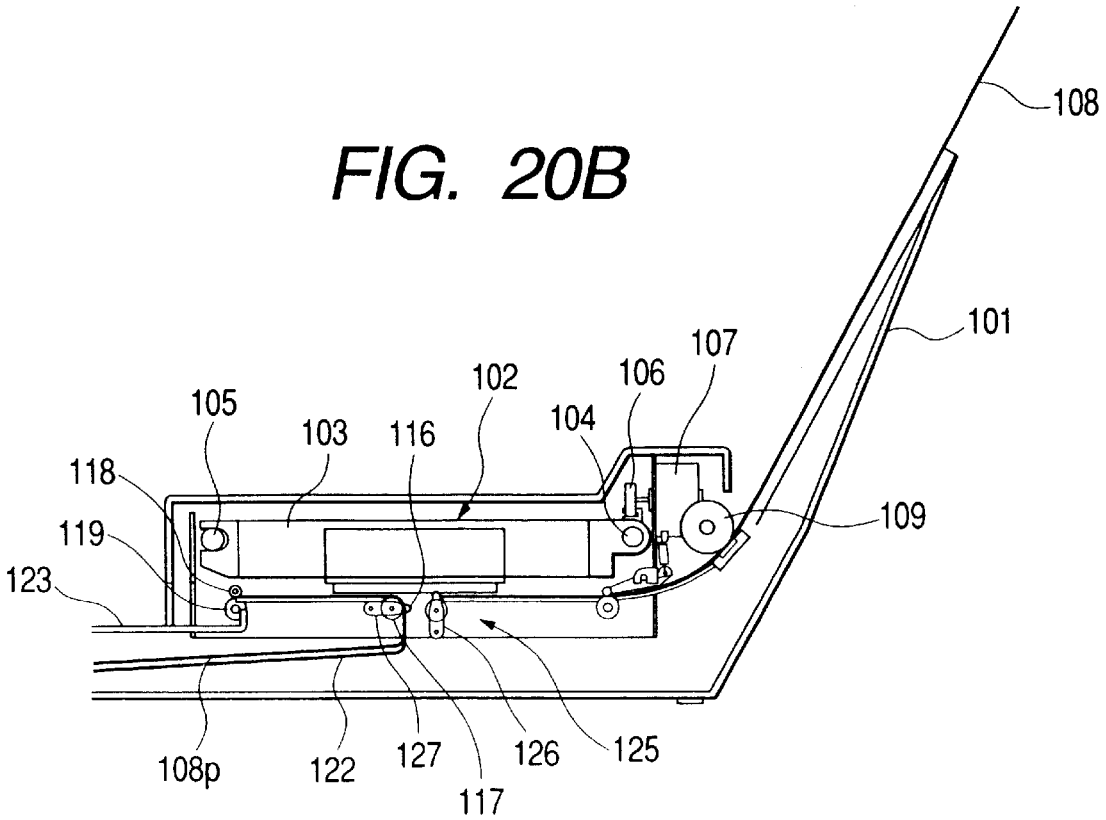

Next, as shown in FIG. 20B, recording is effected on the first side and the link mechanism portion 125 is controlled so that the end portion of the sheet 108*p* held on the intermediate tray 122 can come into the nip portion between the second conveying roller 117 and the second pinch roller 116, and the second arm 127 is pivotally moved so that the second pinch roller 116 may become horizontal relative to the second conveying roller 117. When the end portion of the sheet 108*p* comes into the nip portion between the second conveying roller 117 and the second pinch roller 116, the second arm 127 is pivotally moved with the rotation of the second conveying roller 117, and the sheet 108*p* on the first side of which recording has been effected is conveyed to a position opposed to the second discharge portion of the ink discharge portion of the recording head unit 102. Recording is then effected on a second side of the sheet 108*p* from the second discharge portion, and the sheet 108*pb* on both sides of which recording has been effected is delivered to the delivery tray 123.

Design is made such that when the first arm 126 and the second arm 127 are pivotally moved, the recording head unit 102 stands by at a predetermined position in a direction perpendicular to the main scanning direction so that the arms and the recording head unit 102 may not interfere with each other.

Eleventh Embodiment

Figure 21:
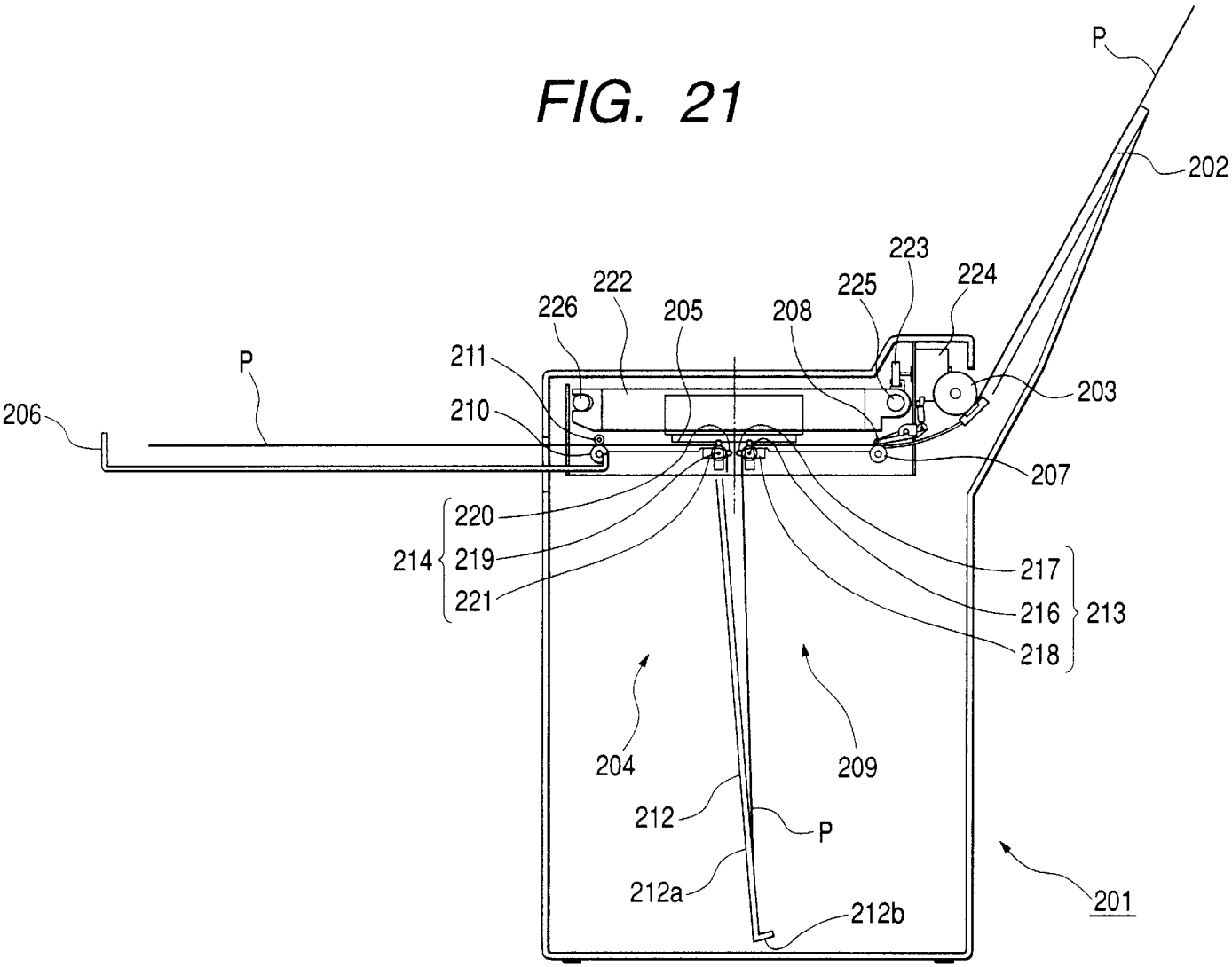
FIG. 21 illustrates the general construction of a recording apparatus according to an eleventh embodiment of the present invention.
Figure 22:
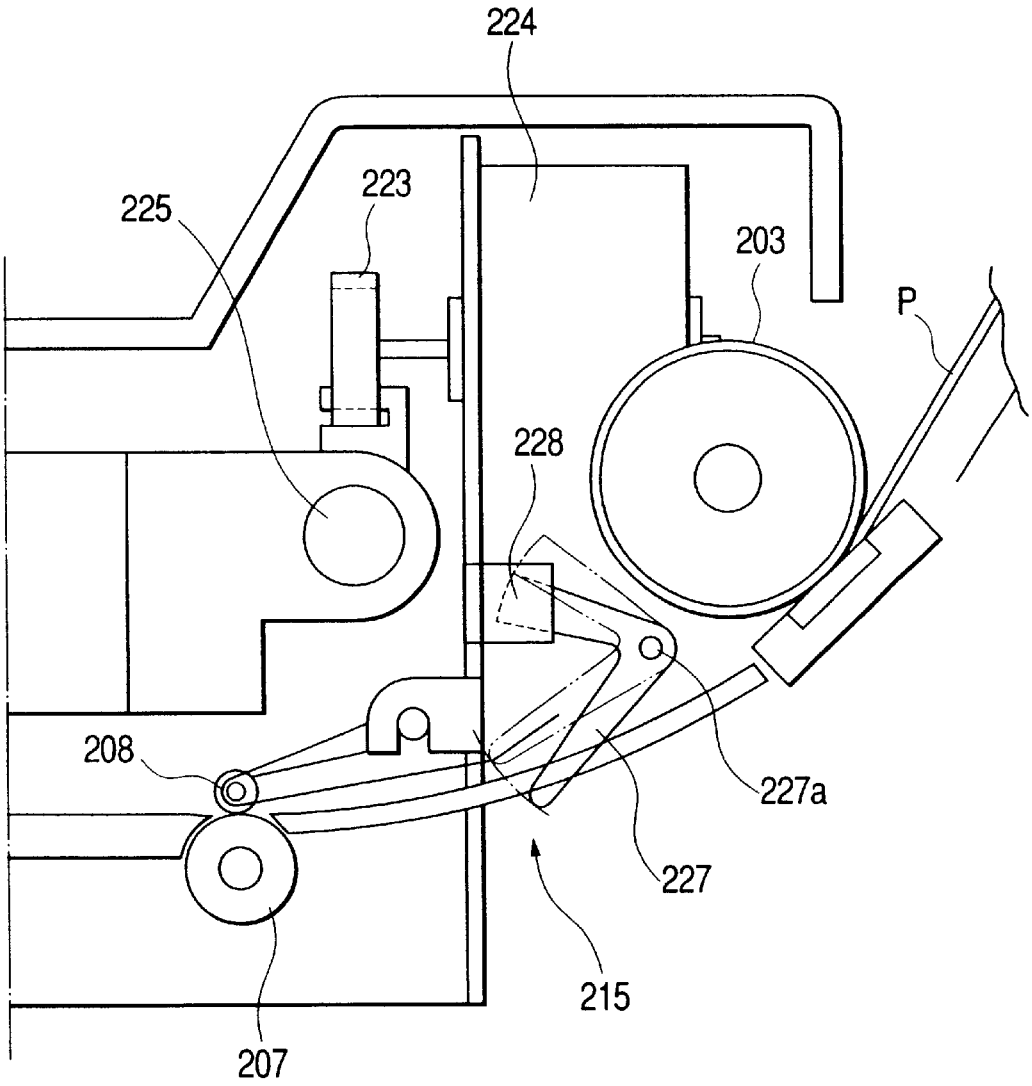
FIG. 22 illustrates detecting means in the eleventh embodiment.
Figure 23:
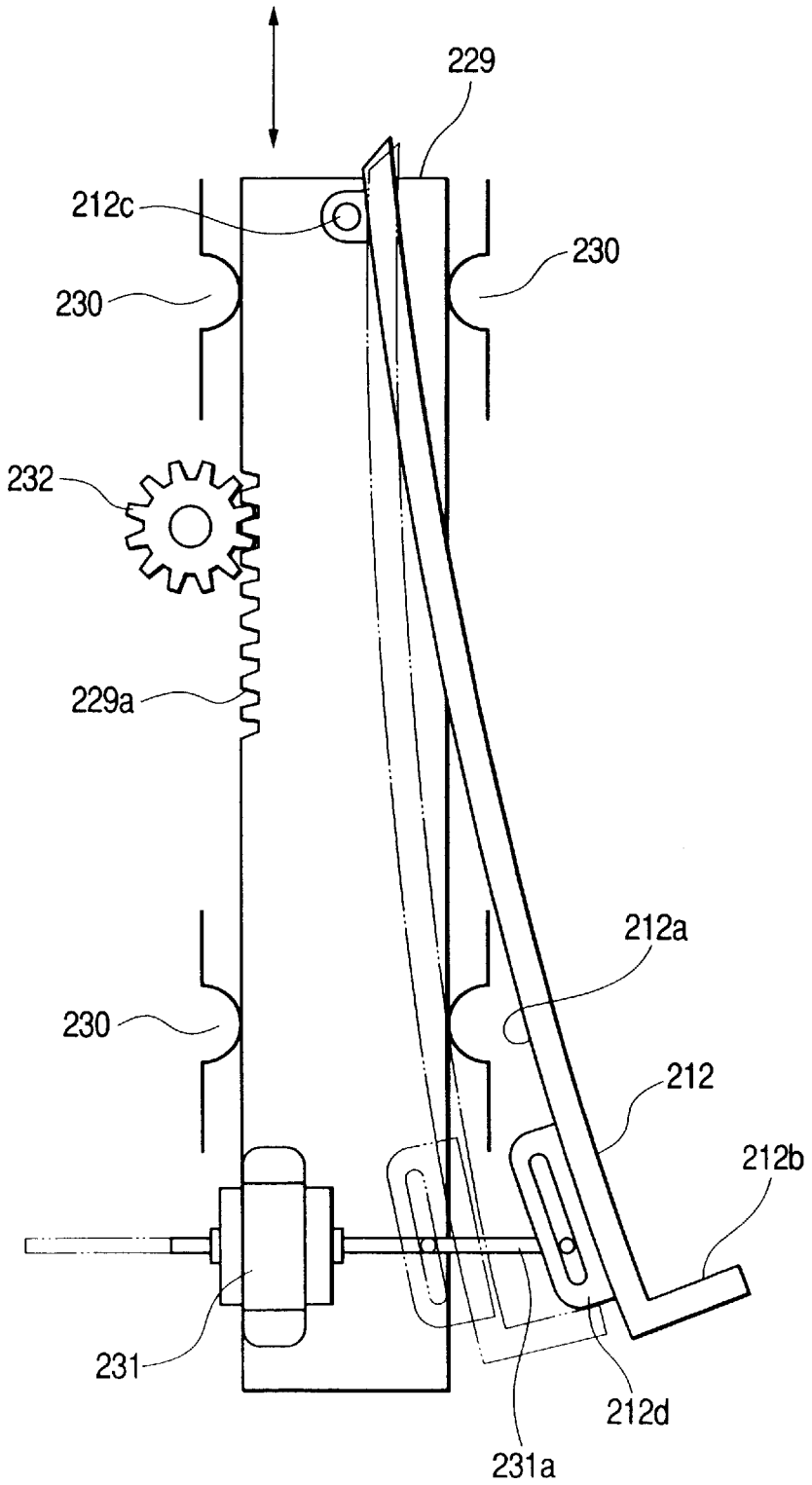
FIG. 23 illustrates an intermediate tray in the eleventh embodiment.

An eleventh embodiment of the present invention will now be described with reference to FIGS. 21, 22, 23 and 24A to 24F. FIG. 21 illustrates the general construction of a recording apparatus according to the eleventh embodiment, FIG. 22 illustrates detecting means, FIG. 23 illustrates an intermediate tray, and FIGS. 24A to 24F illustrate the operation of the recording apparatus.

As shown in FIG. 21, in response to a recording start command from a computer, not shown, connected to the recording apparatus 201, the uppermost one P of sheets stacked on a feed tray 202 is fed to a sheet conveying device 204 by a pickup roller 203. An image is recorded on the sheet P fed to the sheet conveying device 204 by a recording head 205 which is recording means, and the sheet P is delivered onto a delivery tray 206.

The conveyance of and recording on the sheet P by the sheet conveying device 204 and the recording head 205 will be described here in detail.

The sheet conveying device 204 is comprised of an intermediate roller 207, a driven roller 208, sheet reversing means 209, a delivery roller 210 and a delivery driven roller 211. The intermediate roller 207 is a driving rotary member rotatively driven to convey the sheet, and is rotatably journalled. The driven roller 208 is a driven rotary member energized by the intermediate roller 207 and driven to rotate, and is rotated following the rotation of the intermediate roller 207.

The sheet reversing means 209 is comprised of an intermediate tray 212, a first conveying unit 213 and a second conveying unit 214, and is provided at a portion opposed to the recording head 205. Also, the sheet reversing means 209 assumes a T-shape in which the first conveying unit 213 and the second conveying unit 214 which are two sets of conveying units are arranged and an intermediate tray 212 is provided at one (the side opposed to the recording head 205) of two points at positions where at a line linking the first conveying unit 213, the second conveying unit 214 and the intermediate tray 212 together forms the equal sides of a substantially isosceles triangle. The sheet reversing means 209 changes the conveyance direction of the sheet by the first conveying unit 213 to thereby convey the sheet P to the intermediate tray 212, and changes the conveyance direction of the sheet from the intermediate tray 212 by the second conveying unit 214 to thereby convey the sheet to the downstream side.

The intermediate tray 212 is comprised of a stacking plate 212*a* for stacking the sheets thereon and a support plate 212*b* provided in the lower end portion for supporting the sheets, and is provided at a position where at the leading end of the sheet P does not interfere with the stacking plate 212*a*. Also, the intermediate tray 212 can change its distance from the second conveying unit 214 in accordance with the length of the sheet measured by detecting means 215. Also, the intermediate tray 212 is pivotally movable about a hinge 212*c* provided at the upper end thereof by an electromagnetic solenoid (hereinafter referred to as the translating actuator 231).

As shown in FIG. 22, the detecting means 215 is comprised of a sheet detecting lever 227 and a sheet detecting sensor 228, and is provided upstream of the intermediate roller 207 with respect to the conveyance direction. The sheet detecting lever 227 is provided for pivotal movement about a shaft 227*a*. The sheet detecting sensor 228 is an optical sensor which detects the presence or absence of the sheet by light.

When the leading end of the sheet P fed by the pickup roller 203 pushes one end of the sheet detecting lever 227 to thereby pivotally move the sheet detecting lever 227, the state in which the other end of the sheet detecting lever 227 has so far shielded the sheet detecting sensor 228 from light is released, whereby the sheet P is detected. When the sheet P is further conveyed and the trailing end of the sheet P passes one end of the sheet detecting lever 227, the sheet detecting lever 227 is pivotally moved and returns to its original state, and the sheet detecting sensor 228 is shielded from light. The length of the sheet P is then calculated from the time for which the sheet detecting sensor 228 is shielded from light and the speed of the intermediate roller 207.

As shown in FIG. 23, the intermediate tray 212 is journalled to a tray base 229 by means of the hinge 212*c*. The tray base 229 is vertically reciprocally movably supported by a guide 230. The translating actuator 231 is provided on the tray base 229, and the translating pin 231*a* of the translating actuator 231 is fitted in a slot 212*d* formed in the back of the intermediate tray 212. The translating pin 231*a* translates, whereby the intermediate tray 212 is pivotally moved about the hinge 212*c*.

Also, a rack 229*a* is provided on the back of the tray base 229 and is in meshing engagement with a pinion 232. The pinion 232 is driven in forward and reverse directions by a motor, not shown, to thereby vertically reciprocally move the tray base 229 and change the distance between the intermediate tray 212 and the second conveying unit 214.

The first conveying unit 213 is comprised of a first conveying roller 216 which is a driving rotary member rotatively driven to thereby convey the sheet, a pinch roller 217 which is a driven rotary member urged against and rotated by the first conveying roller 216, and a first arm 218, and is provided adjacent to the recording head 205 and above the upper end of the intermediate tray 212 and on the upstream side in the conveyance direction. The first conveying roller 216 rotatably supported on the center of the first arm 218, and the first pinch roller 217 is provided on the tip end of the first arm 218 so as to be urged against the first conveying roller 216 and rotated by the first conveying roller 216. The first arm 218 is pivotally movable about a rotary shaft 216*a* in synchronism with the rotation of the first conveying roller 216.

The second conveying unit 214 is comprised of a second conveying roller 219 which is a driving rotary member rotatively driven to thereby convey the sheet, a second pinch roller 220 which is a driven rotary member urged against and rotated by the second conveying roller 219, and a second arm 221, and is provided adjacent to the recording head 205 and above the upper end of the intermediate tray 212 and on the downstream side in the conveyance direction. The second conveying roller 219 is rotatably supported on the center of the second arm 221, and the second pinch roller 220 is provided on the tip end of the second arm 221 so as to be urged against the second conveying roller 219 and rotated by the second conveying roller 219. The second arm 221 is pivotally movable about a rotary shaft 219*a* in synchronism with the rotation of the second conveying roller 219.

The delivery roller 210 is a driving rotary member rotatively driven to thereby convey the sheet, and is rotatably journalled. The delivery driven roller 211 is a driven rotary member urged against and rotated by the delivery roller 210, and is rotated following the rotation of the delivery roller 210.

The recording head 205 of the ink jet type is carried on a carriage 222 for movement in parallelism to the conveyance direction of the sheet P. The carriage 222 is fixed to a timing belt 223 passed over an idle pulley and an driving pulley, not shown. The driving pulley is directly connected to a carriage motor 224 which is a drive source. Also, the carriage 222 is supported by a guide shaft 225 and a guide shaft 226 for reciprocal movement in the main scanning direction intersecting with the conveyance direction.

Figure 24A:
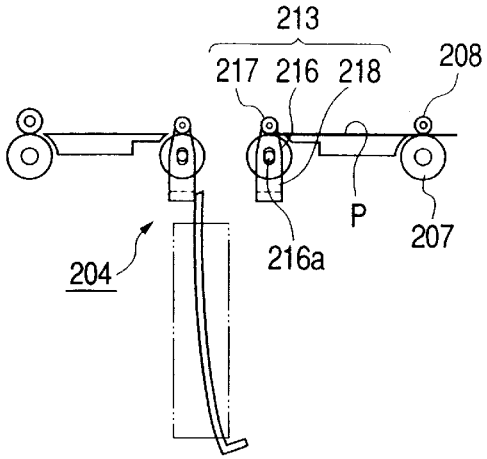
FIGS. 24A, 24B, 24C, 24D, 24E and 24F illustrate the operation of the recording apparatus according to the eleventh embodiment.

As shown in FIG. 24A, the sheet P fed to the sheet conveying device 204 is nipped between the intermediate roller 207 and the driven roller 208 and is conveyed to the first conveying unit 213.

Figure 24B:
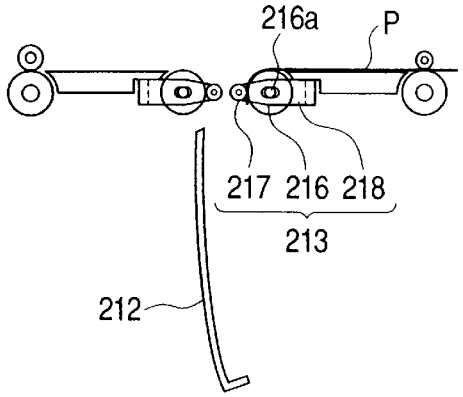

As shown in FIG. 24B, the sheet P conveyed to the first conveying unit 213 is nipped between the first conveying roller 216 and the first pinch roller 217. The first arm 218 is pivotally moved in synchronism with the rotation of the first conveying roller 216, whereby the first pinch roller 217 provided on the tip end of the first arm 218 revolves around the first conveying roller 216 by 90° in the direction for conveying the sheet P to the intermediate tray 212, and the sheet P is twined around the first conveying roller 216 by a predetermined angle. The first pinch roller 217 is fixed at this pivotally moved position. Also, the first arm 218 is pivotally moved in synchronism with the rotation of the first conveying roller 216, and the first pinch roller 217 is retracted to the outside of a recording area and is fixed. In this state, the recording head 205 is moved to the center of the recording area.

The carriage 222 is guided and reciprocally scanned in the main scanning direction by the guide shaft 225 and the guide shaft 226 by the carriage motor 224 being driven. Then, with the conveyance of the sheet P, ink is discharged from the nozzles of the recording head 205 at a position opposed to the sheet P and image recording is effected on the front surface (one side) of the sheet P.

In the present embodiment, the ink discharging construction is designed such that an electro-thermal converting member is electrically energized in conformity with a recording signal, and by the growth and contraction of a bubble created in the ink by the utilization of film boiling of the ink by the heat energy thereof, the ink is discharged from a discharge port to thereby effect recording. Regarding the typical construction and principle thereof, it is preferable to use the basic principle disclosed, for example, in U.S. Pat. Nos. 4,723,129 and 4,740,796.

This method is applicable to both of the so-called on-demand type and the continuous type, and is particularly effective in the case of the on-demand type because at least one driving signal corresponding to recording information and providing a rapid temperature rise exceeding the nudeate boiling is applied to an electro-thermal converting member disposed correspondingly to a sheet or a liquid path in which liquid (ink) is retained, whereby heat energy is generated in the electro-thermal converting member to thereby cause film boiling in the heat acting surface of the recording head 205 with a result that there can be created a bubble in the liquid corresponding to this driving signal in a one-to-one relationship. By the growth and contraction of this bubble, the liquid is discharged through an opening for discharge to thereby form at least one droplet. If this driving signal is made into a pulse shape, the growth and contraction of the bubble take place appropriately on the spot and therefore, particularly excellent discharge of the liquid can be achieved, and this is more preferable.

Also, if the recording head 205 is moved from the center of the recording area to the upstream side in the conveyance direction, the nozzles opposed to the sheet P will become more and the recording speed can be improved.

Figure 24C:
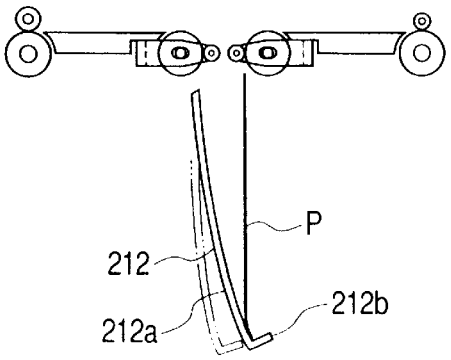
Figure 24D:
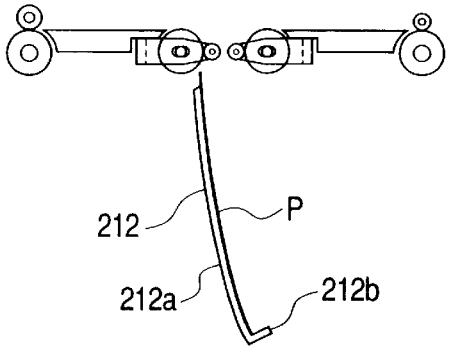

Immediately before as shown in FIGS. 24C and 24D, the sheet P having an image recorded on a first side thereof is conveyed to the intermediate tray 212, the intermediate tray 212 is pivotally moved about the vicinity of the upper end thereof and is fixed at an angle easy to stack the sheet P thereon. The sheet P has its leading end supported by a support plate 212*b* and is stacked on the intermediate tray 212 with the first side thereof on which the image is recorded facing a stacking plate 212*a*.

Figure 24E:
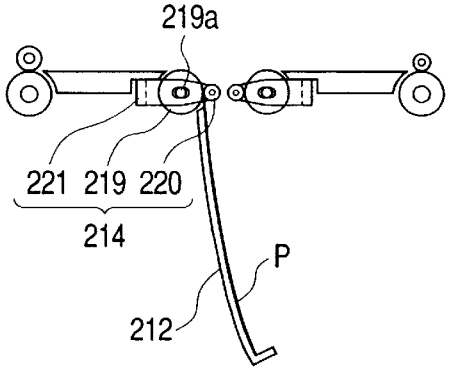

As shown in FIG. 24E, the intermediate tray 212 is moved in accordance with the length of the sheet P measured by the detecting means 215 to thereby change the distance thereof from the second conveying unit 214, and the support plate 212*b* pushes the leading end of the sheet P which has led when coming along the conveyance direction to thereby cause the trailing end of the sheet P to be nipped by the nip portion between the second conveying roller 219 and the second pinch roller 220. By the intermediate tray 212 being thus made movable in conformity with the length of the sheet P, sheets of A4 size, LTR size, B5 size, etc. having different lengths can also be coped with.

Figure 24F:
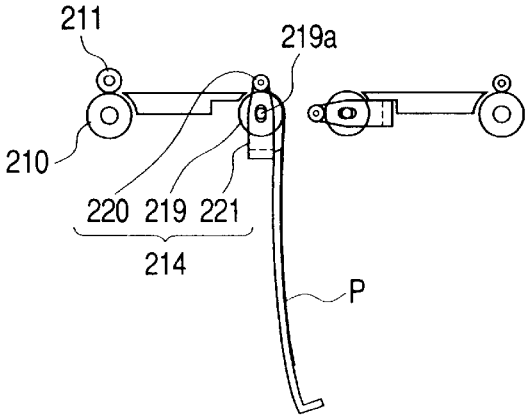

The sheet P having its trailing end nipped by the nip portion between the second conveying roller 219 and the second pinch roller 220, as shown in FIG. 24F, is conveyed with the trailing end in the lead and with a second side (back surface) thereof facing the recording head 205 by the second conveying roller 219 being rotated. The second arm 221, immediately after the conveyance, is pivotally moved around the second conveying roller 219 in synchronism with the rotation of the second conveying roller 219. The second pinch roller 220 provided on the tip end of the second arm 221 revolves around the second conveying roller 219 by 90° in the direction for conveying the sheet P to the recording area with the sheet P twined around the second conveying roller 219 by a predetermined angle, and is moved into the recording area and is fixed therein. In this state, the sheet P is conveyed to the nip portion between the delivery roller 210 and the delivery driven roller 211.

The carriage 222 is guided by the guide shaft 225 and the guide shaft 226 by the carriage motor 224 being driven and is reciprocally moved in the main scanning direction intersecting with the conveyance direction of the sheet P. Then, with the conveyance of the sheet P, the ink is discharged from the nozzles of the recording head 209 at the position opposed to the sheet P and image recording is effected on the second side (back surface) of the sheet P.

If the recording head 205 is moved from the center of the recording area to the downstream side with respect to the conveyance direction, the nozzles opposed to the sheet P will become more and the recording speed can be improved. Also, the position of the recording head 205 can be adjusted in conformity with the amounts of recording data recorded on the first side (front surface) and the second side (back surface) to thereby effect optimum image recording.

Also, while the conveyance of and recording on the sheets have been described with the conveyance of a sheet P as a specific example, the sheet conveying device 204 can be controlled to thereby reverse two sheets at a time by the sheet reversing means 209, and the recording head 205 can also be controlled to thereby effect recording on the sheet before reversed and the sheet after reversed at a time. In this case, the second sheet and the first sheet do not interfere with each other because the leading end of the sheet is provided at a position whereat it does not interfere with the stacking plate 212*a*. The sheet P on both sides of which recording has been effected is then delivered onto the delivery tray 206 by the delivery roller 210 and the delivery driven roller 211.

As is apparent from the foregoing description, according to the present invention, there can be provided a recording apparatus which has a recording head provided with a first discharge portion and a second discharge portion for discharging liquid for recording and performing the recording operation on a recording surface and in which recording is effected on a first side of a recording medium by the first discharge portion, and after a reversing mechanism portion has spaced the first side apart from the first discharge portion, the recording medium is reversed so as to oppose a second side of the recording medium to the second discharge portion, and the recording operation is performed on the second side by the second discharge portion and therefore, recording can be effected quickly and reliably on both sides of the recording medium by the use of a single recording head.

What is claimed is:

1. A recording apparatus for effecting recording on a recording medium by a recording head having a first recording portion and a second recording portion, said recording apparatus comprising:

a recording medium conveying path for conveying the recording medium opposite to the recording head; and a reversing mechanism portion for reversing surfaces of the recording medium in a position opposite to the recording head, said reversing mechanism portion spacing a first side of the recording medium apart from said first recording portion, and thereafter reversing the recording medium so as to oppose a second side of the recording medium to said second recording portion.

2. A recording apparatus according to claim 1, wherein said reversing mechanism portion has conveying rollers and pinch rollers provided correspondingly to said first recording portion and said second recording portion, respectively, and cooperating with each other to nip the recording medium therebetween.

3. A recording apparatus according to claim 1, further comprising a head shift mechanism portion for changing a position of the recording head relative to said recording medium conveying path.

4. A recording apparatus according to claim 3, wherein said head shift mechanism portion changes the relative position of the recording head in conformity with image data for effecting recording on continuously conveyed recording media.

5. A recording apparatus according to claim 3, comprising recording heads independently provided for respective colors, and said head shift mechanism portion changes relative positions of the recording heads for respective colors.

6. A recording apparatus according to claim 1, wherein an image to be recorded only on one side of the recording medium is divisionally recorded on both sides of the recording medium.

7. A recording apparatus according to claim 1, wherein said recording head discharges ink in conformity with a signal to thereby record an image.

8. A recording apparatus according to claim 7, wherein said recording head electrically energizes an electro-thermal converting member in conformity with a signal, and discharges the ink by a utilization of heat energy generated by said electro-thermal converting member.

9. A recording apparatus for effecting recording on a recording medium by a recording head having a first recording portion and a second recording portion, said recording apparatus comprising:

a first driving rotary member rotatively driving to thereby convey the recording medium;

a first driven rotary member driven by said first driving rotary member, said first driven rotary member being journalled so as to revolve around said first driving rotary member while contacting with said first driving rotary member;

a second driving rotary member rotatively driving to thereby convey the recording medium;

a second driven rotary member driven by said second driving rotary member, said second driven rotary member being journalled so as to revolve around said second driving rotary member while contacting with said second driving rotary member; and an intermediate tray for holding the recording medium thereon, said intermediate tray being disposed between said first driving rotary member and said second driving rotary member.

10. A recording apparatus according to claim 9, wherein a conveyance direction of the recording medium is changed by said first driving rotary member and said first driven rotary member and the recording medium is conveyed to said intermediate tray, and the conveyance direction is changed by said second driving rotary member and said second driven rotary member and the recording medium is conveyed from said intermediate tray.

11. A recording apparatus according to claim 9, wherein said intermediate tray is pivotally movable to thereby hold thereon the recording medium conveyed by said first driving rotary member and said first driven rotary member.

12. A recording apparatus according to claim 9, wherein said intermediate tray urges the recording medium against said second driving rotary member and said second driven rotary member.

13. A recording apparatus according to claim 9, further comprising detecting means for detecting a length of the recording medium, and wherein said intermediate tray changes a distance between said intermediate tray and said second driving rotary member and between said intermediate tray and said second driven rotary member in conformity with the length of the recording medium.

14. A recording apparatus according to claim 9, wherein said intermediate tray is disposed in a position opposite to the recording head, and recording is effected on a first side of the recording medium by the recording head before the recording medium is conveyed to the intermediate tray, and recording is effected on a second side of the recording medium by the recording head after the recording medium is conveyed from the intermediate tray.

15. A recording apparatus according to claim 14, wherein said recording head can record on two recording mediums at a time.

16. A recording apparatus according to claim 9, wherein said recording head discharges ink in conformity with a signal to thereby record an image.

17. A recording apparatus according to claim 16, wherein said recording head electrically energizes an electro-thermal converting member in conformity with a signal, and discharges the ink by a utilization of heat energy generated by said electro-thermal converting member.

* * * * *